US006424271B2

(12) United States Patent
Raswant

(10) Patent No.: US 6,424,271 B2
(45) Date of Patent: Jul. 23, 2002

(54) ALTERNATING TIME BAND SEQUENCE "ATBS-2W"

(76) Inventor: Subhash Raswant, 84-49 168th St., Jamaica, NY (US) 11432

( * ) Notice: Subject to any disclaimer, the term of this patent is extended or adjusted under 35 U.S.C. 154(b) by 0 days.

(21) Appl. No.: 09/799,405

(22) Filed: Mar. 5, 2001

Related U.S. Application Data

(60) Provisional application No. 60/187,238, filed on Mar. 3, 2000.

(51) Int. Cl.[7] ..... G08G 1/095

(52) U.S. Cl. ..... 340/907; 340/909; 340/910; 340/917

(58) Field of Search ..... 340/907, 909, 340/910, 911, 917, 919, 924, 925, 918, 922; 404/1

(56) References Cited

U.S. PATENT DOCUMENTS 3,641,486 A * 2/1972 Brockett et al. ..... 340/913
4,303,905 A * 12/1981 Drebinger ..... 340/918
5,278,554 A * 1/1994 Marton ..... 340/910
5,822,711 A * 10/1998 Chavez ..... 340/916

* cited by examiner

*Primary Examiner*—Van Trieu
(74) *Attorney, Agent, or Firm*—Levisohn, Lerner, Berger and Langsam

(57) ABSTRACT

A method and system for controlling a vehicular and pedestrian traffic, which combines a variety of concepts into an integrated operating system for traffic management in cities. The design elements of this system include a combination of the dynamic checkerboard arrangements of alternating bands in paired sets of two or three bands for one-way and two-way streets respectively, the recessed crosswalks, the configuration of the flow pattern for bikeways on one-way grid, the opening of crosswalks on the left side of moving green bands at two-way grid intersections, the placement of bikeways between the sidewalk and the parking lane, and the creation of a separate phase for the movement of bicycle traffic on one-way streets.

23 Claims, 26 Drawing Sheets

ATBS APPLIED TO AN IRREGULAR ONE-WAY GRID PATTERN

TWO WAY TRAFFIC WITH NO LEFT TURNS

BAND DISTRIBUTION ALONG THE AVENUES ON A TWO-WAY GRID

BAND DISTRIBUTION ALONG ALTERNATING TWO-WAY AND ONE-WAY AVENUES.

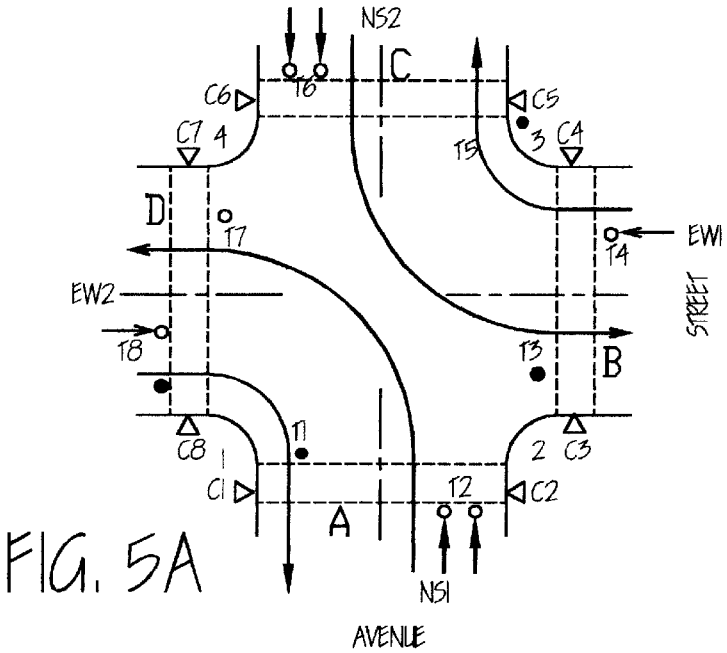
FIG. 5A
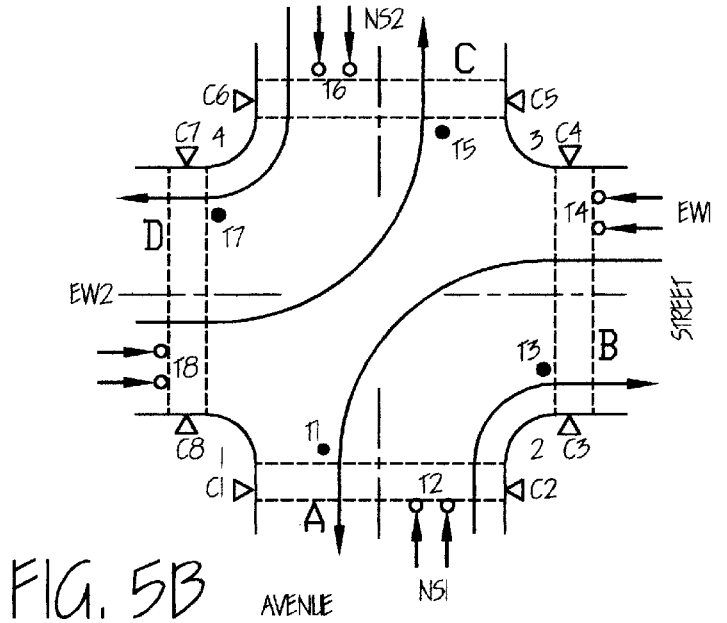
FIG. 5B
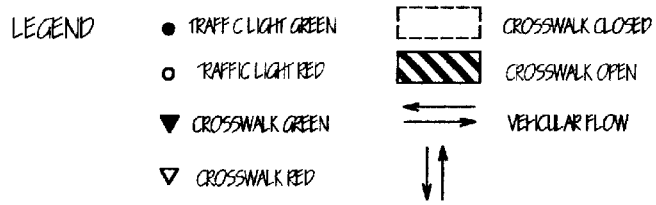

© SUBHASH C. RASWANT

LEGEND

W
E
S N
VEHICULAR FLOW

STOP LIGHT

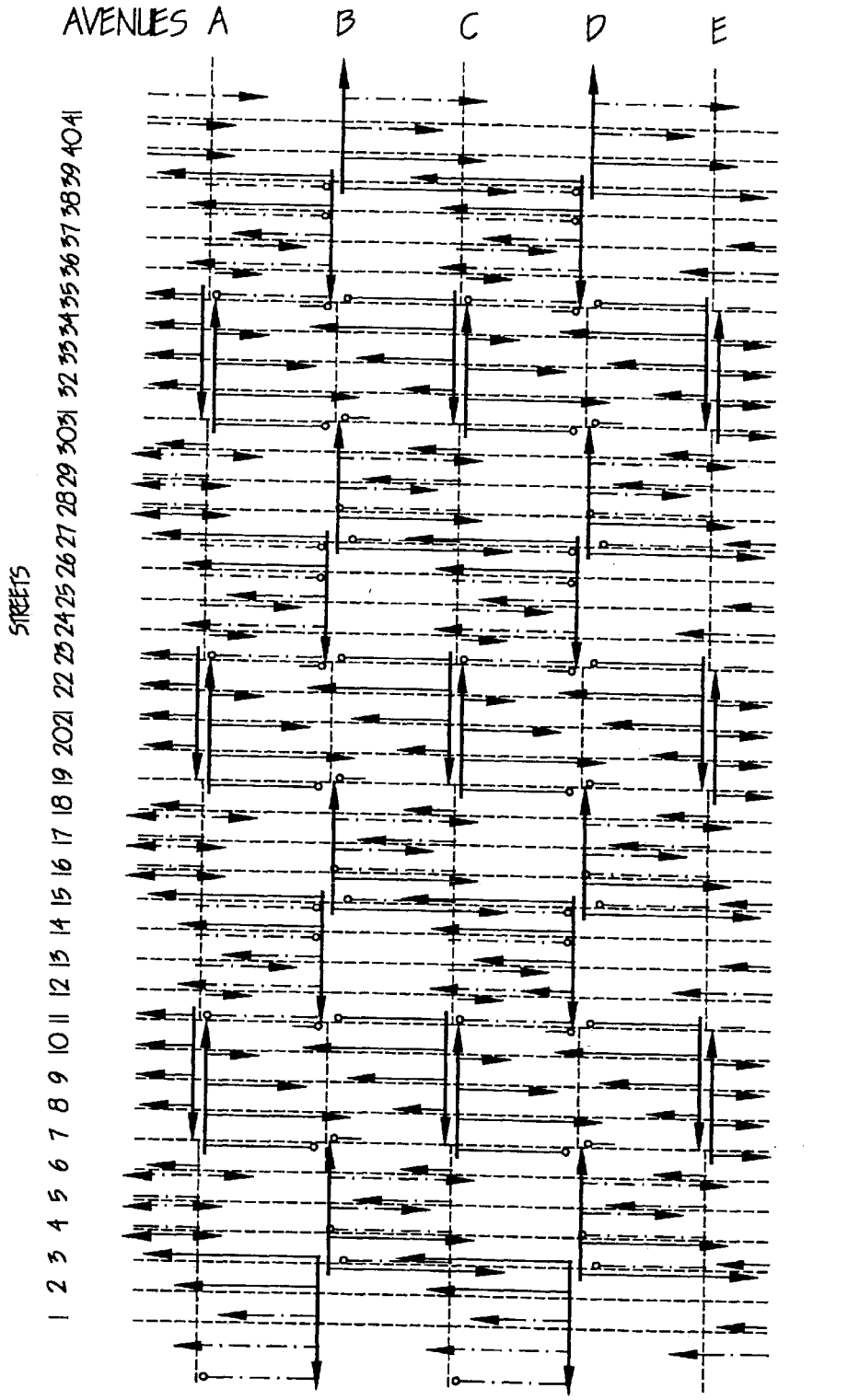
FIG. 6BB
© SUBHASH C. RASWANT
LEGEND
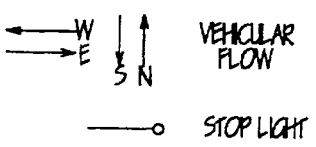

© SUBHASH C. RASWANT

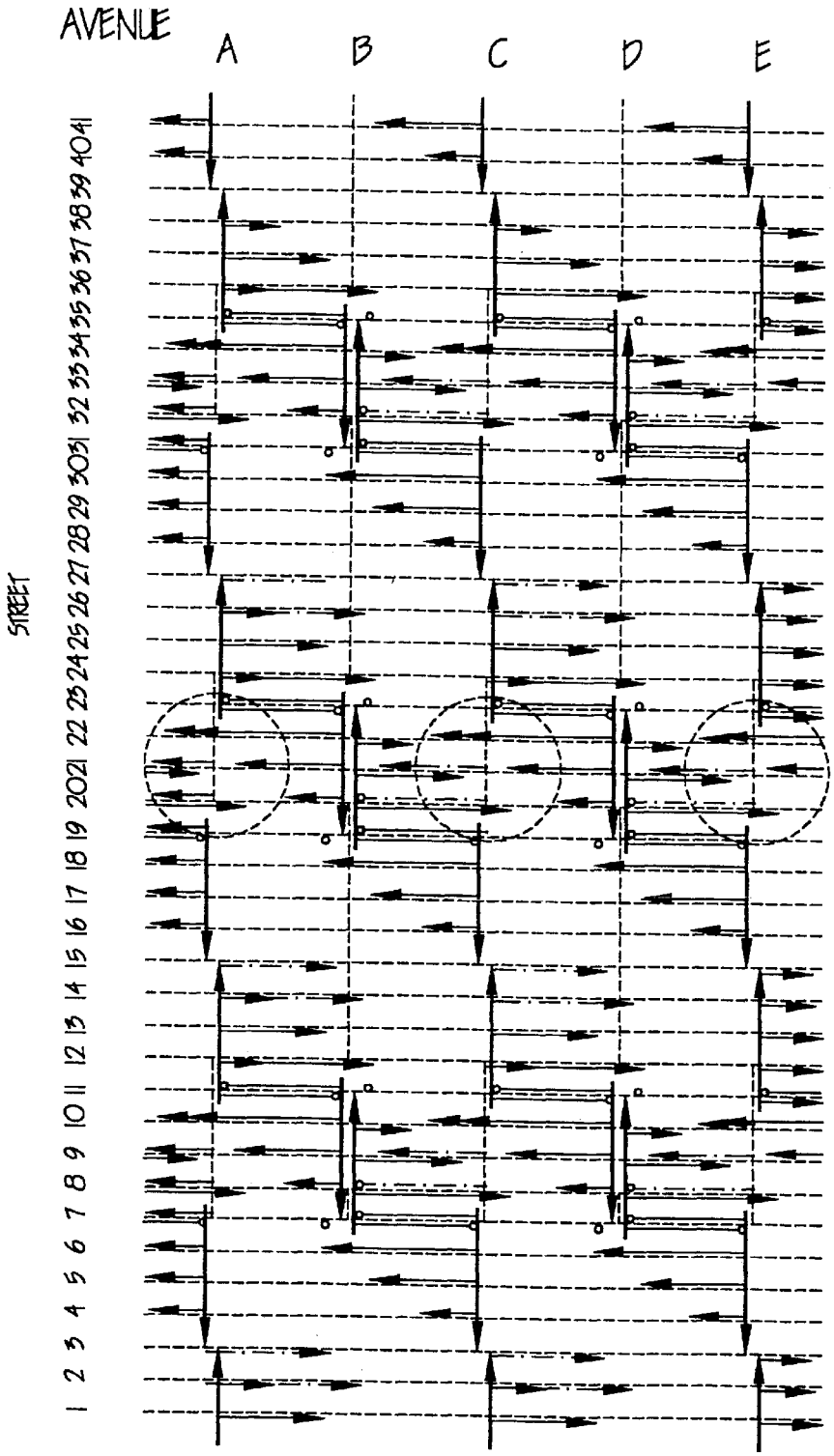
FIG. 6DD
© SUBHASH C. RASWANT
LEGEND
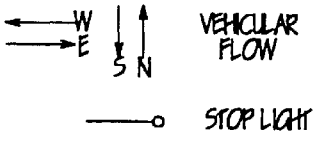

© SUBHASH C. RASWANT

© SUBHASH C. RASWANT

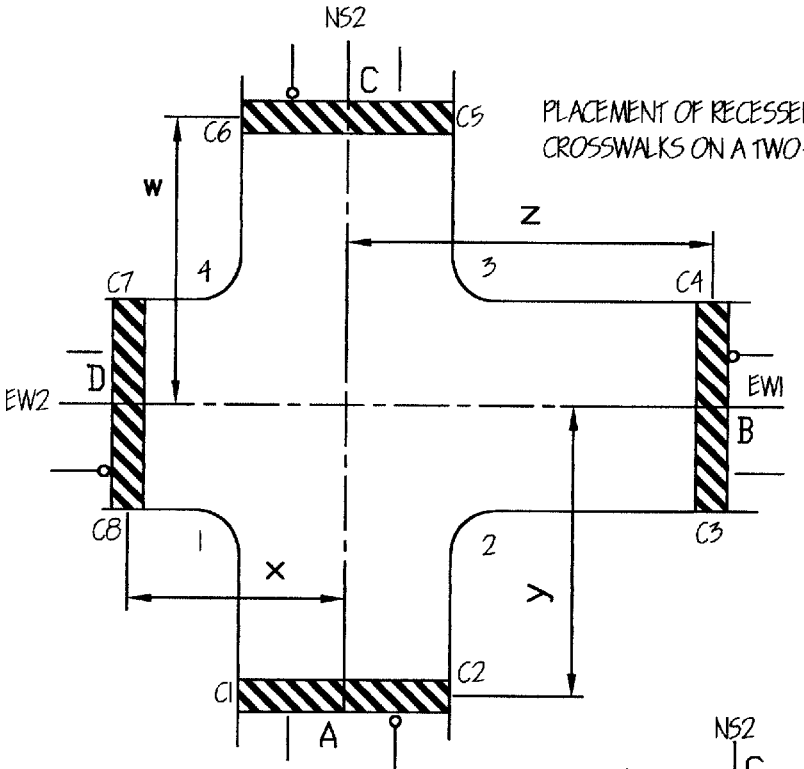
FIG. 7A
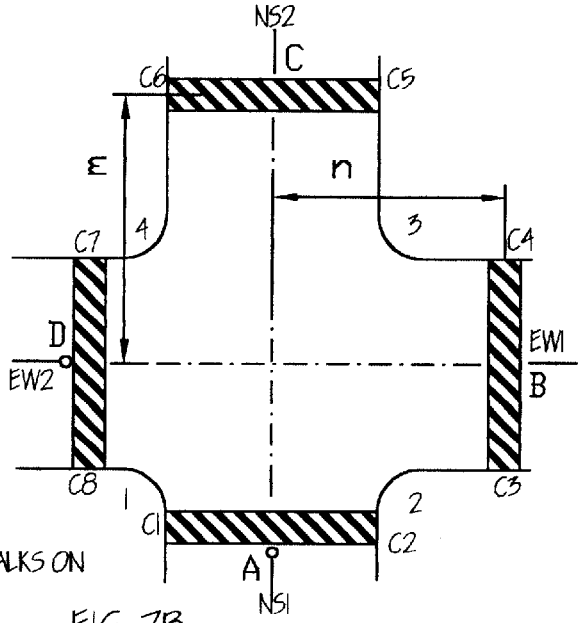
PLACEMENT OF RECESSED CROSSWALKS ON A ONE-WAY INTERSECTION.
FIG. 7B
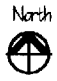
LEGEND
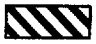
CROSSWALK
STOP LIGHT
CROSSWALK GREEN
CROSSWALK RED
FIG. 7

DISTRIBUTION OF TRAFFIC LIGHTS IN A TWO-WAY STREET SYSTEM. - (See DETAIL E- FIG 3A)

(DWG. Shows open crosswalks only)

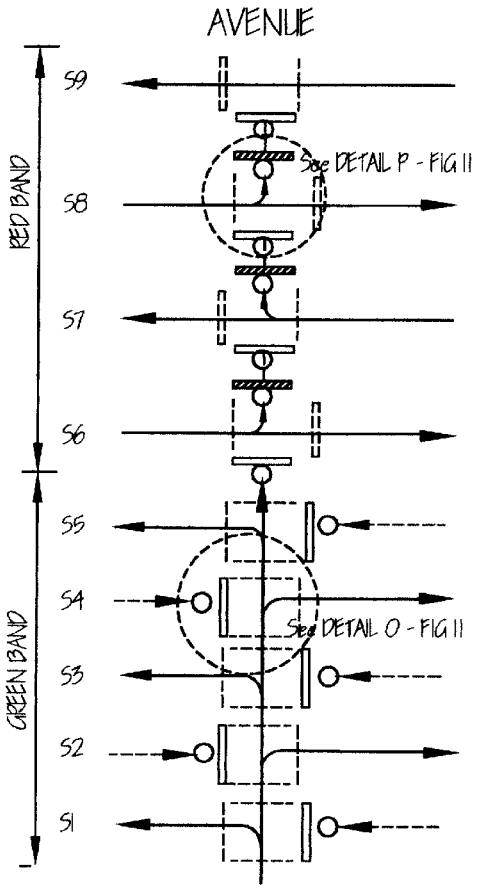
FIG. 8A- A
LINEAR PROGRESSION CODE ON A ONE-WAY GRID STREET
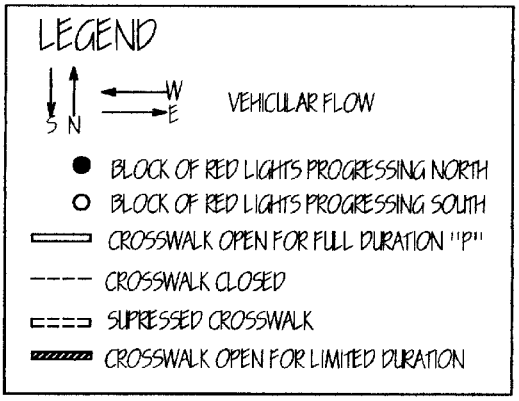
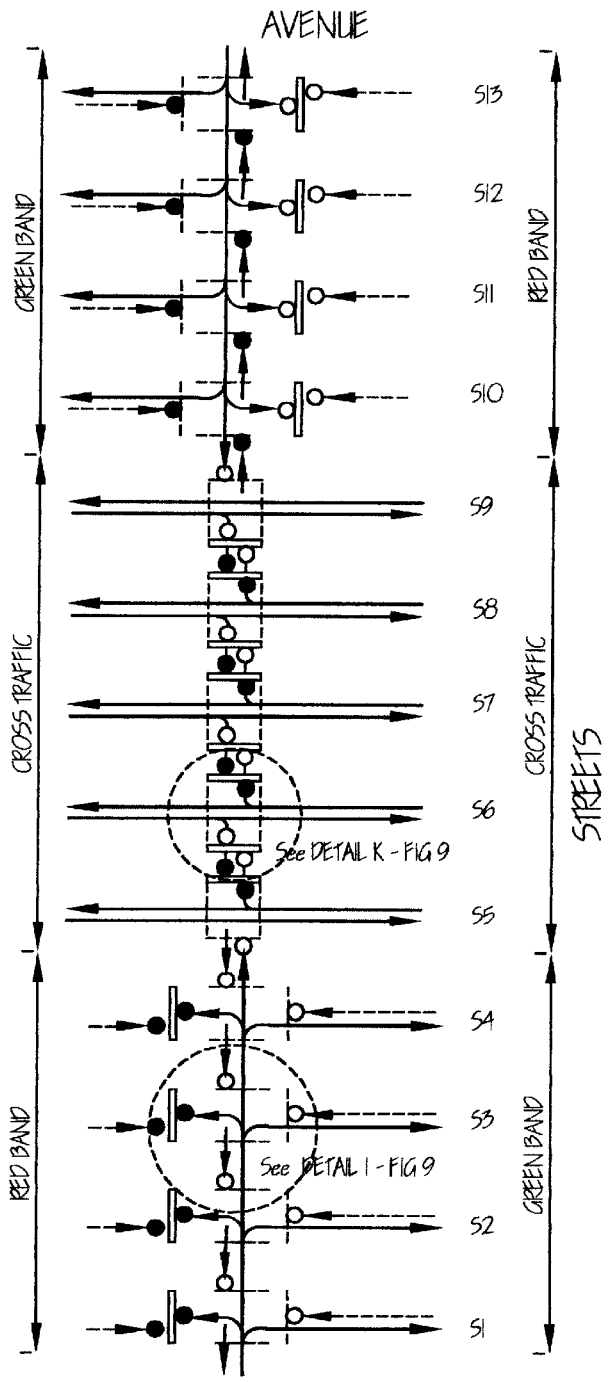
FIG. 8A-B (See Fig.6)
LINEAR PROGRESSION CODE FOR A TWO-WAY GRID STREET
FIG. 8A
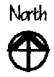

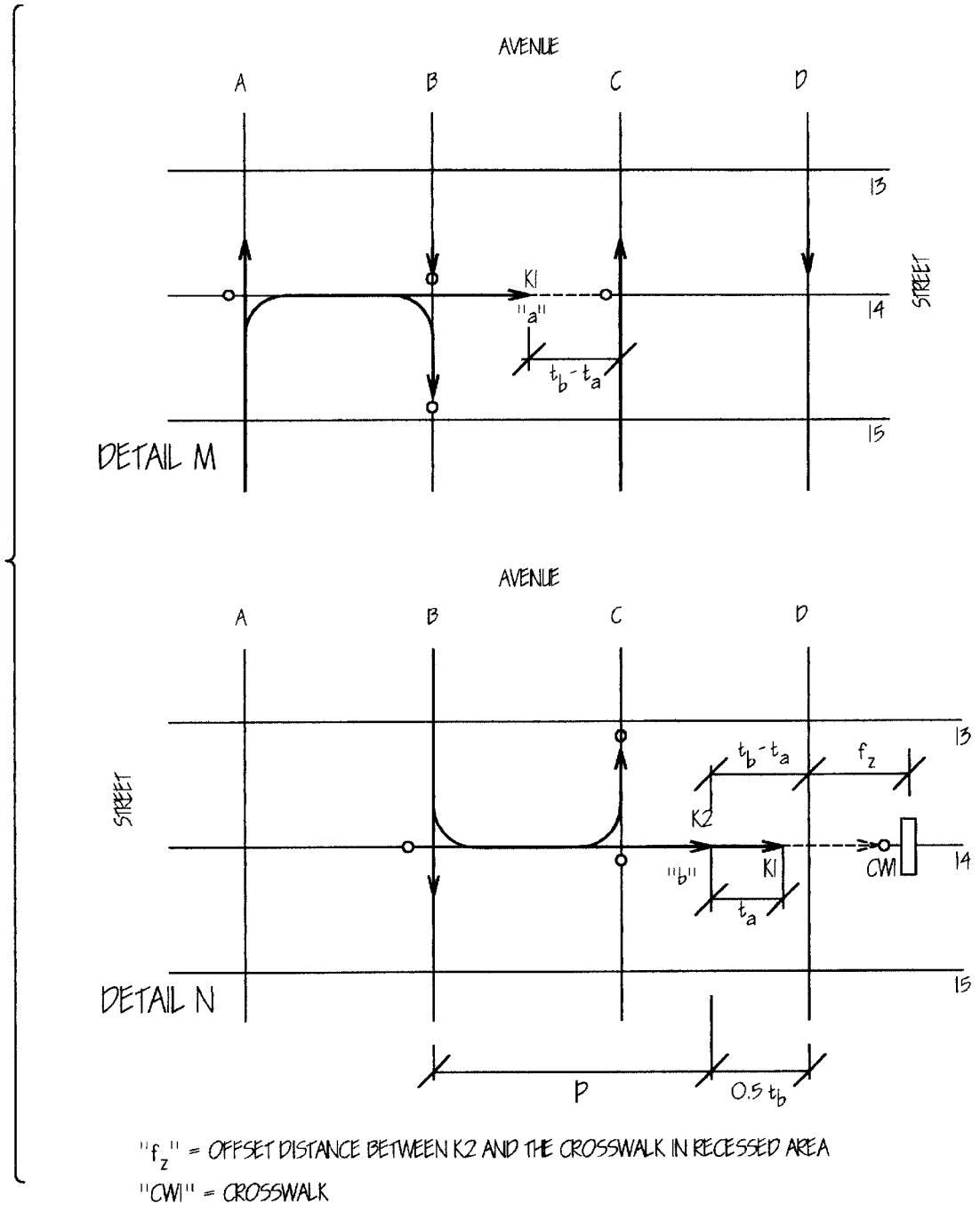
"$f_z$" = OFFSET DISTANCE BETWEEN K2 AND THE CROSSWALK IN RECESSED AREA
"CWI" = CROSSWALK
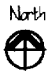
FIG. 10 SEE DETAIL B-FIG 1

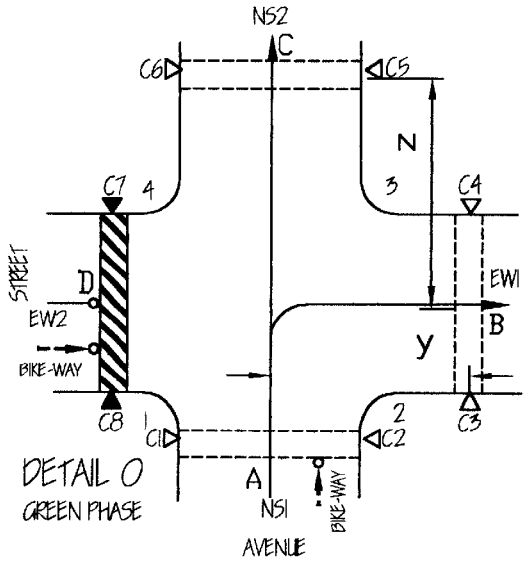
DETAIL O
GREEN PHASE
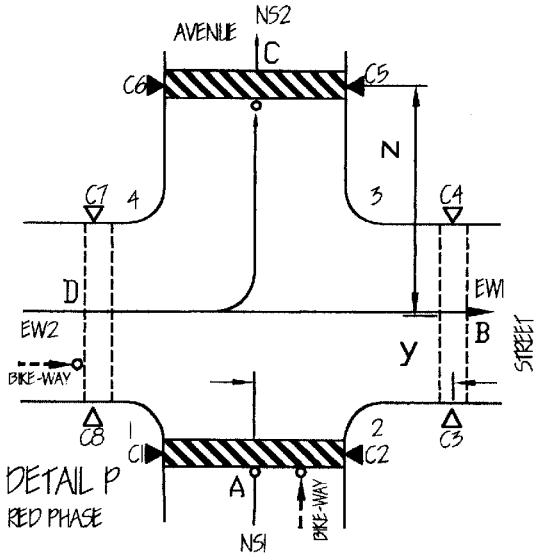
DETAIL P
RED PHASE
THREE PHASE SIGNALIZATION ON ONE-WAY STREET SYSTEM WITH BICYCLE PATHS.
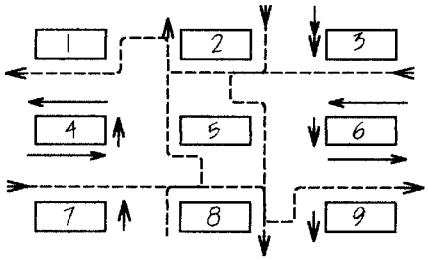
DETAIL Q - BIKE-WAYS
PATTERN FOR MOVEMENT OF BICYCLES ON A ONE-WAY GRID PLAN.
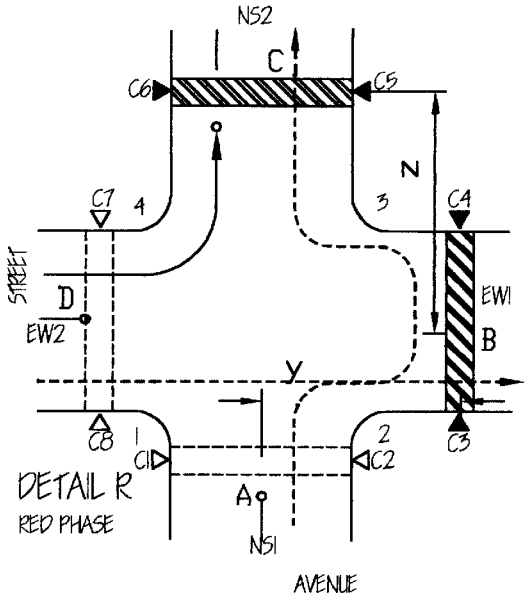
DETAIL R
RED PHASE
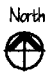
FIG. 11
LEGEND
- ● TRAFFIC LIGHT GREEN
- ○ TRAFFIC LIGHT RED
- ▼ CROSSWALK GREEN
- ▽ CROSSWALK RED
- OPEN CROSSWALK
- CLOSED CROSSWALK
- → AUTOMOBILE WAY
- → BIKE WAY

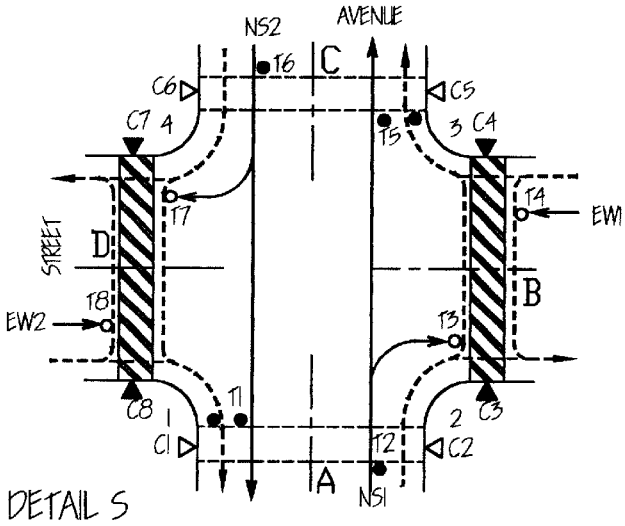
DETAIL S
SEE DETAIL K-FIG 6 FOR CONTEXTUAL RELATIONSHIP
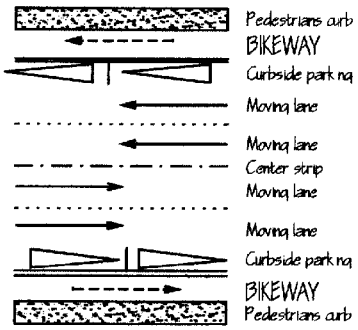
DETAIL U
BIKEWAYS ON A TWO-WAY STREET SYSTEM.
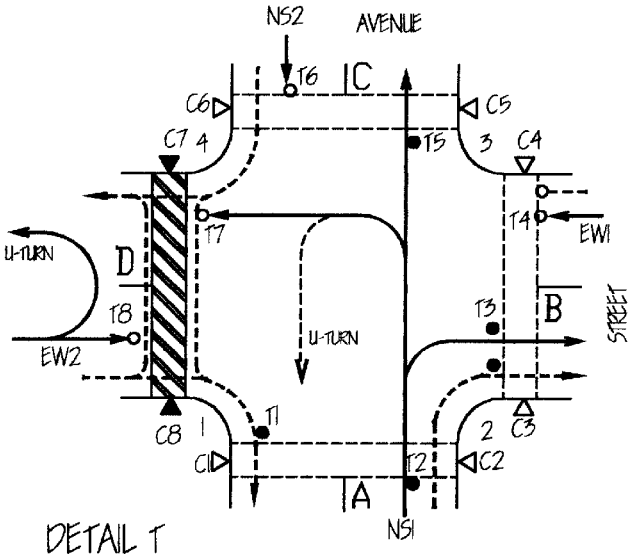
DETAIL T
BICYCLE FLOWS ON TWO-WAY STREETS.
SEE DETAIL H- FIG 6
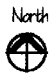
FIG. 12
LEGEND
- TRAFFIC LIGHT GREEN
- TRAFFIC LIGHT RED
- CROSSWALK GREEN
- CROSSWALK RED
- OPEN CROSSWALK
- CLOSED CROSSWALK
- AUTOMOBILE WAY
- BIKE WAY

ALTERNATING TIME BAND SEQUENCE "ATBS-2W"

RELATED APPLICATIONS

This application claims the priority of U.S. Provisional Application Ser. No. 60/187,238, filed Mar. 03, 2000, the disclosure of which is incorporated herein by reference.

FIELD OF THE INVENTION

The present invention generally relates to a coordinated system of vehicular and pedestrian traffic flow and traffic light control. More specifically, the present invention is an integrated model for reorganizing traffic flow and signalization on city streets to maximize safety and minimize delays without grade separation devices.

BACKGROUND OF THE INVENTION

User dissatisfaction with city traffic is derived out of a variety of well-documented concerns, which, among others, include delays, cumbersome and frustrating frequency and duration of red lights encountered at street intersections, safety, and inability to efficiently integrate a third mode of transportation such as bicycles into the existing traffic management policy. Additionally, the movement of automobile and pedestrian traffic at street intersections is insufficiently resolved, and the prevailing pattern of signalized movement at street intersections is generically accident prone.

A larger problem is framed in an environment wherein the physical dimensions of existing street plans, including road geometry and land-use are fixed, and traffic composition, volume and behavior are constantly changing in a space-time continuum. The traffic planner employs street signalization and signage to manage and/or regulate traffic flow on city streets. Policing is an additional tool.

The inventor's personal interest in the problem has resulted in several patented concepts. The "Multiple Loop System" of street circulation, hereinafter "MLS", the subject of U.S. Pat. No. 4,927,288 (fully incorporated herein by reference) issued May 22, 1990, offers a simple and efficient means for eliminating the possibility of vehicle gridlock by providing for better traffic flow on existing street networks. The '288 patent discloses a road traffic network, wherein the fundamental building block is an endless loop of one way traffic flow completely surrounded by a second endless loop having traffic flow opposite in direction to the traffic flow direction of the first loop with an interconnecting traffic flow roadway between the loops.

U.S. Pat. No. 5,092,705 (fully incorporated herein by reference) issued Mar. 3, 1992, relates to a method for minimizing conflicting flows between vehicular and pedestrian traffic on one-way intersections. In brief, the '705 patent relates to a method for controlling the vehicular traffic light signals at intersections of avenues and crosswalks, along with "Walk"/"Don't Walk" traffic signals for pedestrians at the crosswalks, so that the Multiple Loop System operates to its maximum efficiency, all while preserving safety and reducing intermodal conflicts.

Another patent that has relevance to the Multiple Loop System is U.S. Pat. No. 5,330,278 (fully incorporated herein by reference) issued Jul. 19, 1994. This patent teaches a system of signalization that minimizes delays by facilitating two-way progression on MLS based grid networks. Here, two phase traffic signals, red and green, of equal duration are employed at the roadway intersections in such a manner that idling time is minimized while vehicular traffic flow is maximized, all with reduced intermodal conflicts.

The above patents are interrelated and MLS based. Two recent patents, U.S. Pat. Nos. 5,821,878 and 5,959,553 (both fully incorporated herein by reference), are titled "Coordinated Two Dimensional Progression Traffic Signal System", which is also referred to hereinafter as "ATBS," i.e., the "Alternating Time Band System" of street signalization. The present disclosure, referred to as "ATBS-2W", develops additional algorithms that improve on disclosures of '278, '878 and '553 references in the following aspects: it discloses an improved arrangement of alternating bands for two-way streets systems; it fully integrates crosswalks into the ATBS-2W signalization policy to minimize friction, and/or, to eliminate conflicting flows (at grade) at grid intersections; and it discloses a method for integrating dedicated bikeways into existing street plans, and the ATBS-2W signalization policy, for both one-way or two-way street systems.

SUMMARY OF THE INVENTION

It is an object of the present invention to provide an improved arrangement of alternating bands for two-way streets systems.

It is another object of the present invention to fully integrate crosswalks into the ATBS-2W signalization policy to minimize friction, and/or to eliminate conflicting flows (at grade) at grid intersections.

It is a further object of the present invention to provide a method for integrating dedicated bikeways into existing street plans, and the ATBS-2W signalization policy, for both one-way or two-way street systems, within the framework of a unified method for street signalization.

Other objects, advantages and features of this invention will be more apparent hereinafter.

ATBS-2W combines a variety of concepts into an integrated operating system for traffic management in cities. Design elements of ATBS-2W include a combination of dynamic checkerboard arrangements of alternating bands in paired sets of two or three bands for one-way and two-way streets respectively, recessed crosswalks, the configuration of the flow pattern for bikeways on one-way grid, opening of crosswalks on the left side of moving green bands at two-way grid intersections, placement of bikeways between the sidewalk and the parking lane, and creation of a separate phase for the movement of bicycle traffic on one-way streets. In accordance with the invention, crosswalks are preferably open either one at a time or in pairs, in tandem with green bands on two-way avenues and/or streets. On one way streets, crosswalks may also be open in pairs or, where safety is a concern, one at a time, when the traffic signal along the intersecting avenue is green. The remaining crosswalks on one-way street, will then be open during the red signal at the same intersection.

The mathematical variables in the ATBS-2W algorithm are driven by a notional value of time interval "P" as one constant. According to Equation 1 (see below), "P" is the outcome of $t_a$, $t_b$ & $f_t$, i.e. the travel time along one avenue block; travel time along one street block and the time delay required to make a turn. The user can determine "P" by assigning appropriate speeds along the avenue and the intersecting street based on traffic volume and other factors. As traffic volume increases speed tends to decline, particularly as the demand to capacity ratio (V/C) approaches unity. Since "P" varies inversely with speed, it and the cycle length C will increase with traffic volume, consistent with current practice. Under the present system C=3P for two-way streets, and C=2P for one-way streets.

The decision framework includes the acceptance of a method to progress traffic for both sides of two-way streets independently. An adoption of the present method opens one crosswalk only during a green phase and "two or three" crosswalks during the red phase in a "two or three phase" signal cycle, for one-way grids. The present method also integrates bicycle flow with that of the crosswalk policy on both one-way and two-way streets.

The forgoing model cannot in itself cover the full variety of street conditions, layout or network design that may be found in a global context. It does not cover the anomalies in individual behavior, changes in vehicular composition such as trucks, buses and or motorcycles; nor does it account for street congestion due to traffic accidents, delivery vehicles, and/or construction activity, etc. The combined algorithm nevertheless creates a powerful tool to develop or customize a series of ATBS-2W based stand-alone or add-on software products that may each be designed to serve a specific purpose that can include, a. Simulation studies, b. Planning studies, or c. Real Time applications (see below).

The Real Time Software based on ATBS-2W, when applied on the ground to discrete areas or zones will use network servers to regulate signal timings at street intersections via individual controllers. The signal timings will reflect actual counts of vehicular traffic on any given street grid at programmed intervals in a day or week as necessary. Traffic counts may be collected by either of two methods: a use of traffic sensors on the ground, such as loop detectors or microwave sensors, or by locking into a Global Positioning System (GPS) with communication chips that are embedded into automobiles. Individual applications will have to be custom built into "Real Time Software" derived out of the ATBS-2W algorithm for each application. The end result is that of a future development of Intelligent Street Networks (ISN). These when combined with a future use of hybrid electric vehicles, LED Signals and digital controllers, can improve energy conservation.

BRIEF DESCRIPTION OF THE DRAWINGS

A full understanding of the invention can be gained from the following description of the preferred embodiments when read in conjunction with the accompanying drawings in which:

FIG. 5A illustrates one set of signals for two-way traffic to turn off from the N/S axis to the E/W axis.

FIG. 5B illustrates the second set of signals for two-way traffic to turn off from the E/W axis to the N/S axis as illustrated.

FIGS. 6AA–6FF show the changed configuration of traffic flow along two-way streets when left turning traffic is stopped before the recessed crosswalks.

FIG. 7A illustrates placement of recessed crosswalks on a two-way intersection.

FIG. 7B illustrates placement of recessed crosswalks on a one-way intersection.

FIG. 8A-A illustrates a linear progression code on a one-way grid street.

FIG. 8A-B illustrates a linear progression code on a two-way grid street.

FIG. 10 shows Details M & N—FIG. 10 illustrating the underlying logic in a progression cycle, when vehicular traffic originating at node A/14 turns in an easterly direction, in the context of Detail B shown in FIG. 1.

FIG. 11 illustrates three-phase signalization on one-way street system with bicycle paths (Details O, P and R) and a pattern of bicycles' movement on a one-way grid plan (Detail Q).

FIG. 12 illustrates bicycle traffic crossing intersections by making a "jug handle maneuver" alongside the open crosswalk (Details S & T); Detail U shows a preferred location for dedicated bikeways on both sides of two-way streets or avenues, i.e. between the sidewalk and the parallel parking lane.

DETAILED DESCRIPTION OF THE PREFERRED EMBODIMENT AND THE DRAWINGS

The succeeding disclosure is written for countries with the right hand model of traffic circulation similar to U.S.A. For other countries with left hand model of traffic circulation such as the U.K. all references to left or right turns are to be read in reverse, as mirrored right and left turns.

The time interval P is central to the ATBS-2W algorithm. Its value can change between areas with different grid dimensions, land-use, time of the day, or season. In such an environment, a proper definition of geographic zones is a first step in applying ATBS in any location. This should preferably be followed by a preliminary determination of "P" based on field notes and pre-existing data sets, for different times of the day or week. On one-way streets, the signal cycle C=2P and is consistent for each zone. On two-way systems, the signal cycle is 3P to accommodate the flow of traffic in an opposite direction at each node. It is to be understood that, when the invention is implemented in a real city traffic environment, the signal cycle C may be adjusted, i.e., increased or decreased by several seconds depending on empirical studies. The length of red and green bands remains equal, as in the one-way system. The phasing sequence changes from node to node within bands, as apparent in Table 1 (see below). In a practical application where travel time can change between nodes, the signal phasing will have to be independently derived for individual nodes within a mathematical logic. The value of "P" is kept constant for the street system as a whole.

The ATBS policy is based on a conceptual definition of a grid plan wherein the various roads or streets are classified either as avenues, typically along a major axis, or as streets, typically along a minor axis. The major axis is selected based on the volume of vehicular flow in a given direction of a two-way grid. In the present ATBS 2W progression model, roads along the major axis (be they arterials, avenues or streets) are defined as avenues. The streets intersecting these avenues are signalized in sync with the ATBS 2W progression model for the avenues.

Figure 1:
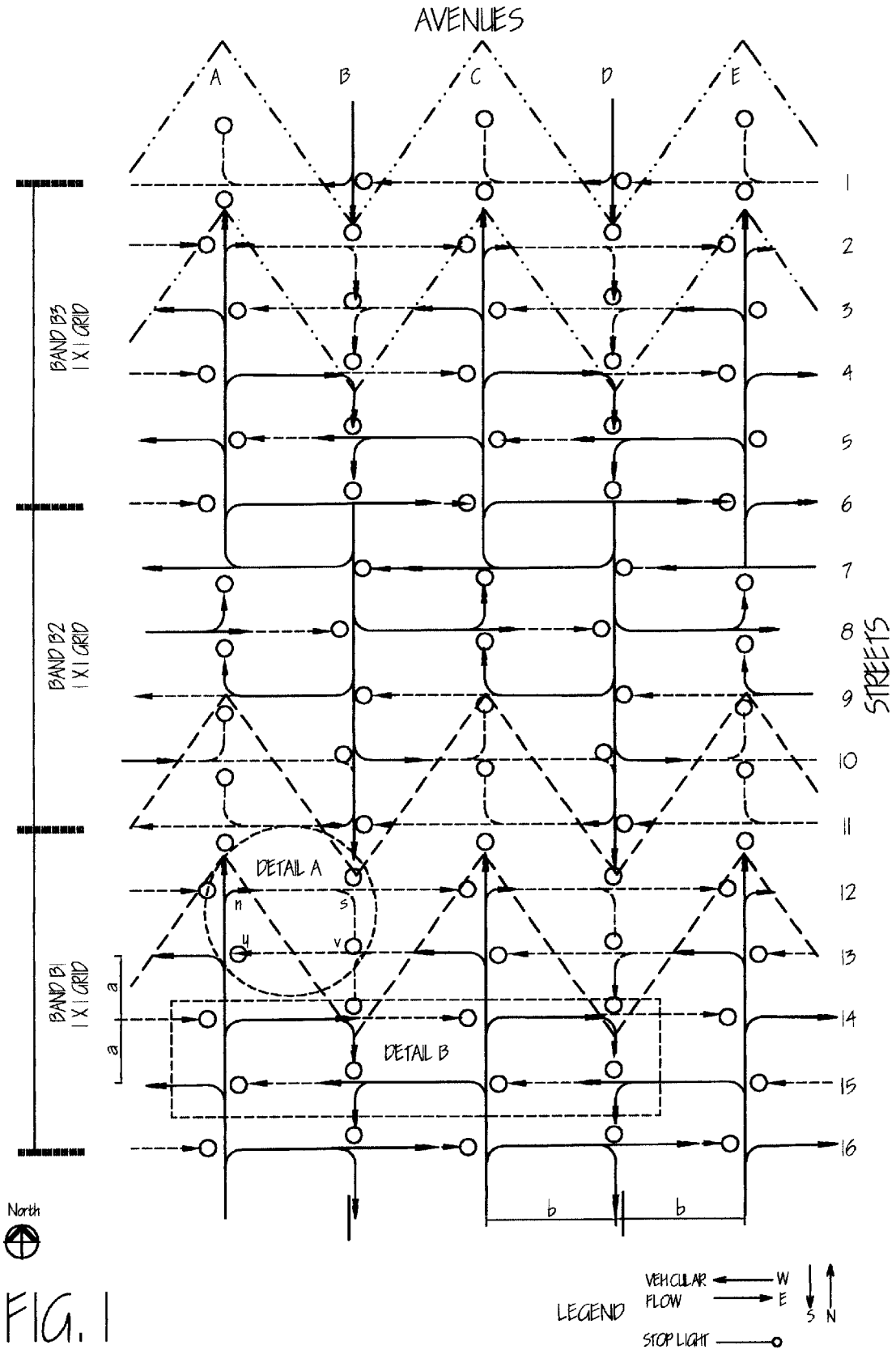
FIG. 1 illustrates a time motion diagram for vehicular movement in a single phase of a (two-phase) signal cycle, for a one-way grid plan.

Previously disclosed in U.S. Pat. Nos. 5,821,878 and 5,959,553, FIG. 1 illustrates a time motion diagram for vehicular movement in a given moment in time during a single phase of a dynamic two-phase signal cycle, for a one-way grid plan. Here the traffic crosses street intersections along either axis. Vehicular flows are highlighted by heavy lines terminating in arrows; red lights are indicated by circular dots; North-South (N/S) avenues are designated alphabetically "A" through "E." East-West (E/W) streets are designated numerically "1" through "19". The N/S alignment of the grid is segmented into three equal band lengths B1, B2 & B3. The larger arrangement is that of an interlocking checkerboard pattern. The pattern of movement along the avenues is such, that all nodes within the red bands are "on-loading" traffic off the side streets, while all nodes in the adjacent green bands are either "off-loading" traffic onto the side streets, or, moving forward along the avenue. Traffic off-loading onto the side streets is either able to move past an adjacent intersection on an adjacent avenue, or to turn off onto the adjacent avenue. The earlier ABTS model is generally operated within the framework of a two-phase signal cycle for "one-way grids", wherein the red and green intervals are equal (or nearly equal); the amber ("yellow") interval is a part of the green interval. The present model, similarly to the earlier ATBS model, is dynamic, and the relative relationship of red and green bands is both repetetive and constantly changing in time, as shown in FIG. 1 for one such moment in time.

As shown in FIG. 1, within individual bands all intersections are in reciprocal and opposite signal phases, relative to one another. Thus, when traffic lights in band B2, along avenues A, C, & E, are at a green signal, traffic lights on adjacent cohort intersections, along avenues B & D, also within band B2, are in a red phase and vice versa. Simultaneously, street intersections within contiguous Band Lengths along each avenue are in opposite phases of the signal cycle relative to one another. Thus, when intersections in band B2 along "Avenue C" are in a green phase, intersections in contiguous bands B1 and B3 are in a red phase and vice versa. Nodes along band interfaces on a grid plan are also in opposite phases relative to one another, and the alternating bands dovetail into one another by one node, as in FIG. 1.

When travel distances and speeds between nodes along streets and avenues are assumed to be the same, "P" ("P" being a unit of time in seconds) is obtained by calculating the time required for a vehicle to traverse two continuous road lengths at the perimeter of a typical grid rectangle. Thus, as shown in FIG. 1, Detail A, "P" is determined by the amount of time required for a vehicle to traverse the distance from node "n" to node "v" via node "s." When travel distances between avenues and streets are "b" and "a," respectively, and travel times are consistently determined to be "$t_b$" and "$t_a$", respectively, time interval P may be determined as:

$$P=t_b+t_a+2f_t \text{ (when } t_b>t_a\text{)}, \qquad \text{Equation 1}$$

$$P=2(t_b+f_t) \text{ when } t_b=t_a \text{ (in seconds)}. \qquad \text{Equation 1a}$$

In the above equations, $f_t$, or turning factor, is the time in seconds required to make one turn.

Equations 1 and 1a imply a condition wherein a "round-the-block" (RB) maneuver is accomplished in exactly two phase changes, or one signal cycle C. Herein after a vehicle travels from node "n" to node "v" via node "s" in a first phase interval; it can travel back to node "n" from node "v" via node "y" in a second phase, provided travel times remain the same for both halves of the grid quadrant.

ATBS-2W expands the scope of earlier concepts to accommodate real world conditions with changing street distances and speeds. Thus, "P" can change for each half of a typical RB maneuver, as apparent in FIG. 1A. A notional computation of the signal cycle C when derived from an RB computation on a one-way grid will be:

$$C=P_1+P_2 \qquad \text{Equation 2}$$

Figure 1A:
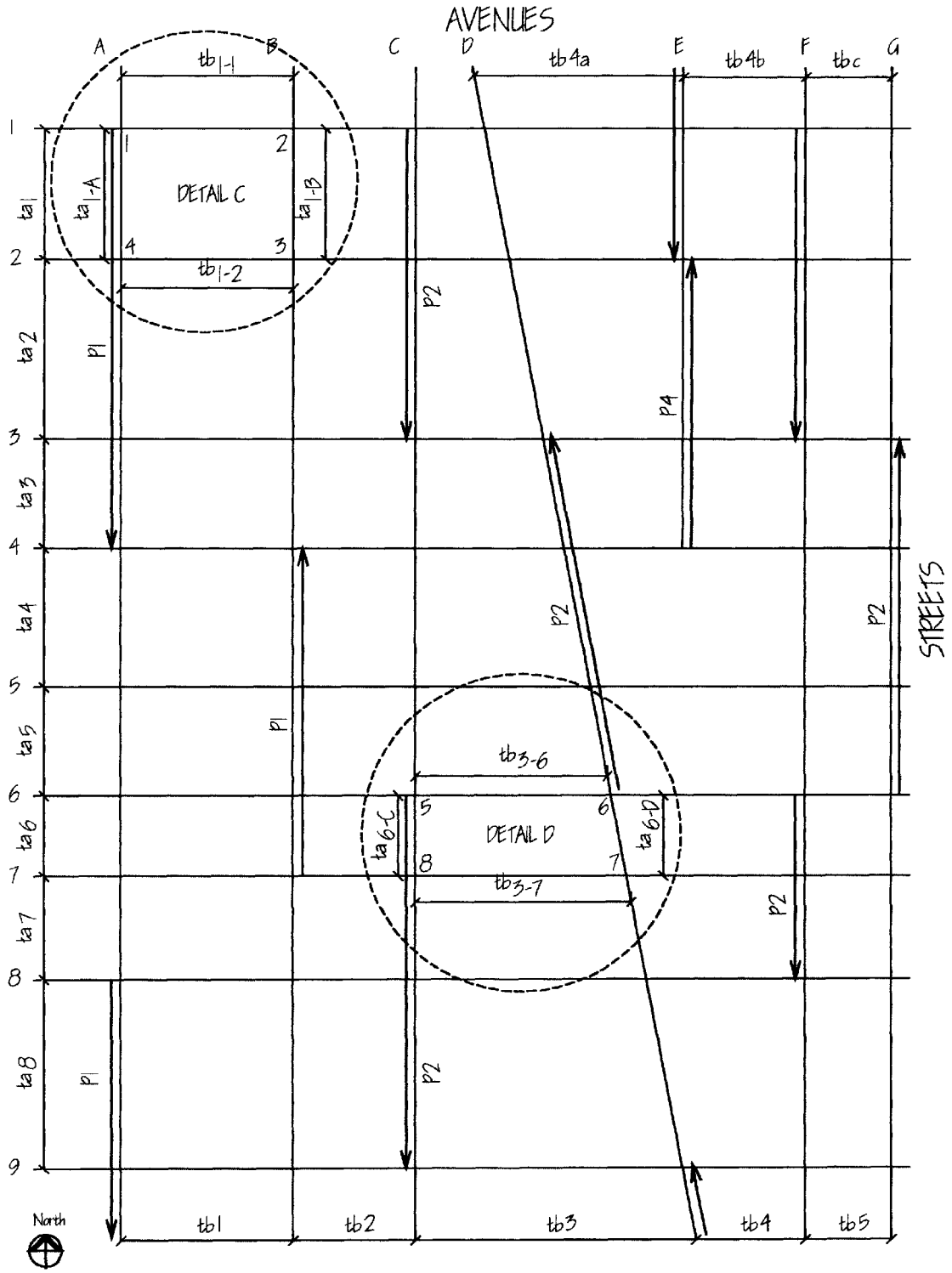
FIG. 1A illustrates a street diagram where travel distances change between links.

With respect to FIG. 1A, Detail C:

$$P_1=ta_{1-A} \text{ (along } Av.A)+tb_{1-1}(\text{@ Street 1})+2f_t$$

$$P_2=ta_{1-B} \text{ (along } Av.B)+tb_{1-2}(\text{@ Street 2})+2f_t$$

$$P(\text{as an average})=(P_1+P_2)/2 \qquad \text{Equation 3}$$

Also in the earlier disclosures, a "Band Length" is defined as the maximum number of street intersections a given vehicle platoon length is likely to traverse for the duration of any time interval "P". It's numeric value "n" is a whole integer and is determined by the following ratio:

$$n=P/t_a \text{ (when } t_b>t_a\text{)} \qquad \text{Equation 4}$$

When travel times between all nodes along an avenue are assumed to be a constant "$t_a$" for all links within Bands for a street system as a whole.

In the current disclosure, when, as in FIG. 1A, travel speeds and travel distances change between links, the value "P" is derived as the sum of time required to cover a set of travel distances, "n" is not usually a whole integer, it is the number of nodes that may be traversed during said unit of time "P". This process of aggregated total of travel time is preferably applied to the grid system as a whole, as long as the band length "P" is kept constant.

$$P=\Sigma(t_{a1}+t_{a2}+t_{a3}+\text{etc}),$$

for each band.

Even though P is constant, the value of "n" can change between street segments, thus, removing the earlier constraint that "$t_b>t_a$", see Equation 4.

FIG. 1A also demonstrates that ATBS policy is equally relevant to "perfect" grids, i.e., grids with equal grid distances for both sides of the grid quadrant, or "imperfect" grids alike. This is made apparent in the relative configuration of travel times (as opposed to travel distances) around two quadrants shown in FIG. 1A "Detail C," a rectangle, and "Detail D," a quadrant with different grid dimensions. The incongruity in terms of travel times about the four sides of both quadrants is similar.

Figure 2:
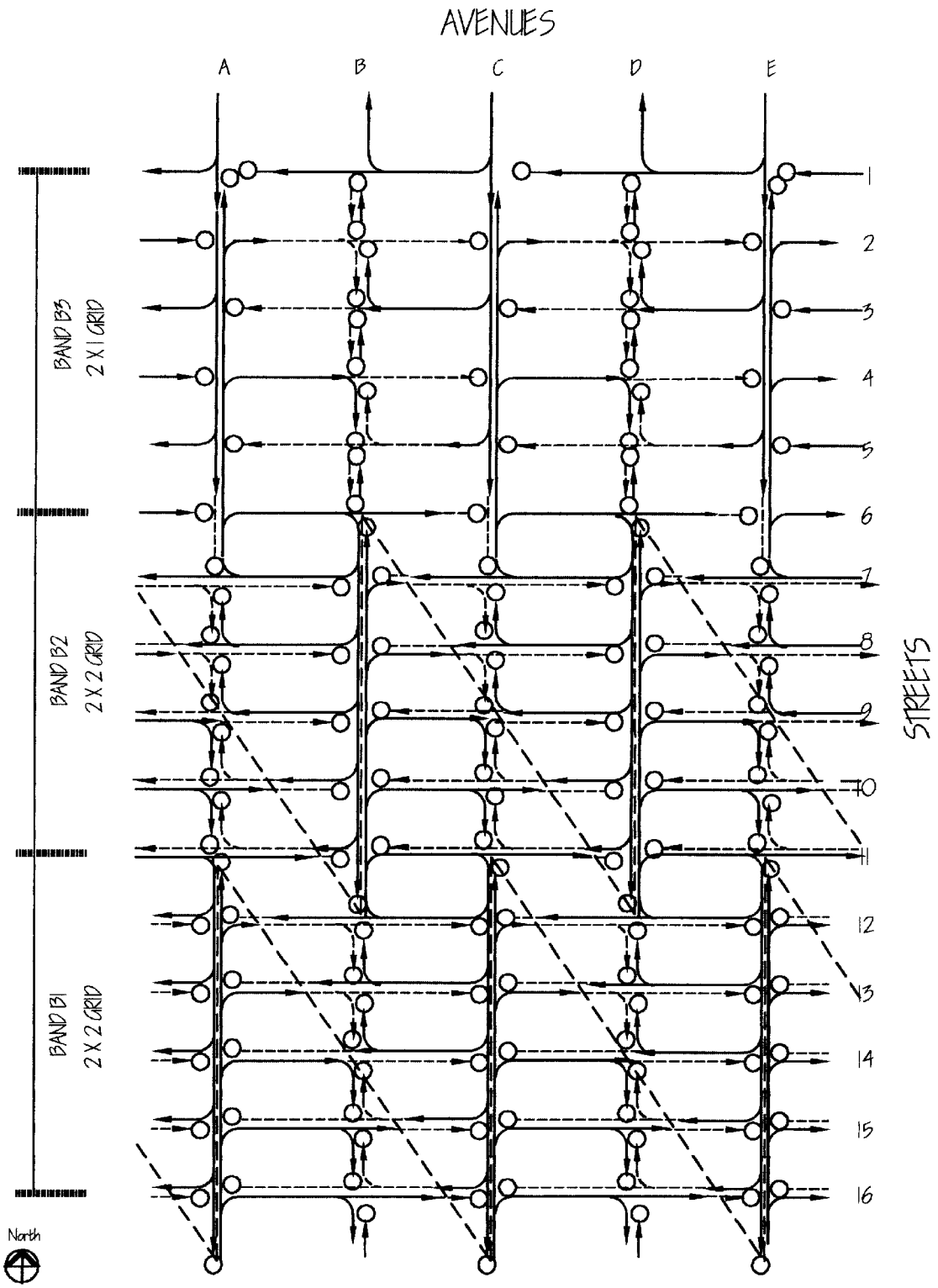
FIG. 2 illustrates how ATBS can be applied to grid networks with two-way streets in an alternating arrangement of "one on one" red & green band configuration provided "left turns" are prohibited.

Similarly to the one-way system of FIG. 1, earlier disclosures of '878 and '553 patents demonstrated that ATBS could also be applied to grid networks with two-way streets in an alternating arrangement of "one on one" red & green band configuration, as shown in FIG. 2, provided "left turns" are prohibited. The present disclosure, ATBS-2W details a new and different sequence for two-way progression with "protected left turns". It also discloses that red and green signal-phases change from node to node in a set pattern, within repetitive band lengths in the two-way system.

Figure 3A:
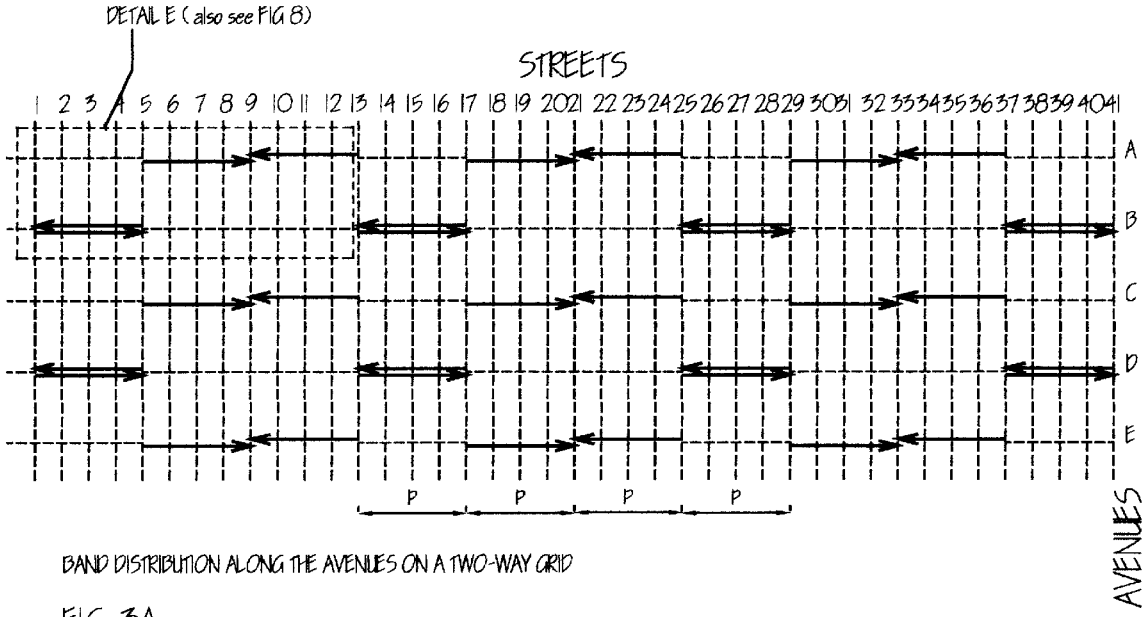
FIG. 3A demonstrates an improved band distribution moving along both directions of each two-way avenue when traffic flow progresses independently in both directions of the two-way avenue.

The value of "P" for both red and green bands is fixed, the same as in the one-way system disclosures identified above. To achieve this consistency in the value of P, ATBS-2W allows traffic flows to progress independently in both directions of two-way streets. FIG. 3A demonstrates sets of three bands moving along both directions of each two-way avenue, one such set is outlined as Detail E. Each of these sets is in turn configured in a paired combination of red and green bands for traffic flow along the two directions of an avenue together with one or two bands for street traffic to cross the two-way avenues. In said arrangement, at any given time the red or green bands are either converging towards each other, diverging from each other, overlapping each other, or traffic from side streets is crossing open bands along the avenues. In FIG. 3A, when in each pair of three bands on alternate Avenues A, C and E, two green bands are converging and the third band is open to cross traffic. Simultaneously, two bands are open to cross-traffic along Avenues B & D in alignment with the red and green bands on Avenues A, C, & E; and a third band along Avenues B & D has overlapping green bands in alignment with that of crossing street traffic on Avenues A, C & E.

Traffic signals for each two-way avenue may be viewed as pairs of continuous and repetitive strings of three bands, which in turn are collectively progressed as clusters of light signals, at a determined speed along both sides of each two-way avenue or for an entire grid zone. The relative relationship of these bands is continuously changing with respect to one another and with respect to that of similarly configured bands on adjacent avenues in a space-time continuum. Traffic lights are progressed at a given design speed for a plurality of avenues within an urban setting. Any larger urban configuration can in turn have a plurality of zones. The final appearance for a two-way grid is that of a complex checkerboard arrangement (in tandem sets of three bands), wherein the opportunity for through and cross traffic is linked to the movement of red and green bands along the avenues. The signal cycle "C" for two-way grids is "3P," as opposed to the "2P" signal cycle for one-way grids.

Figure 3B:
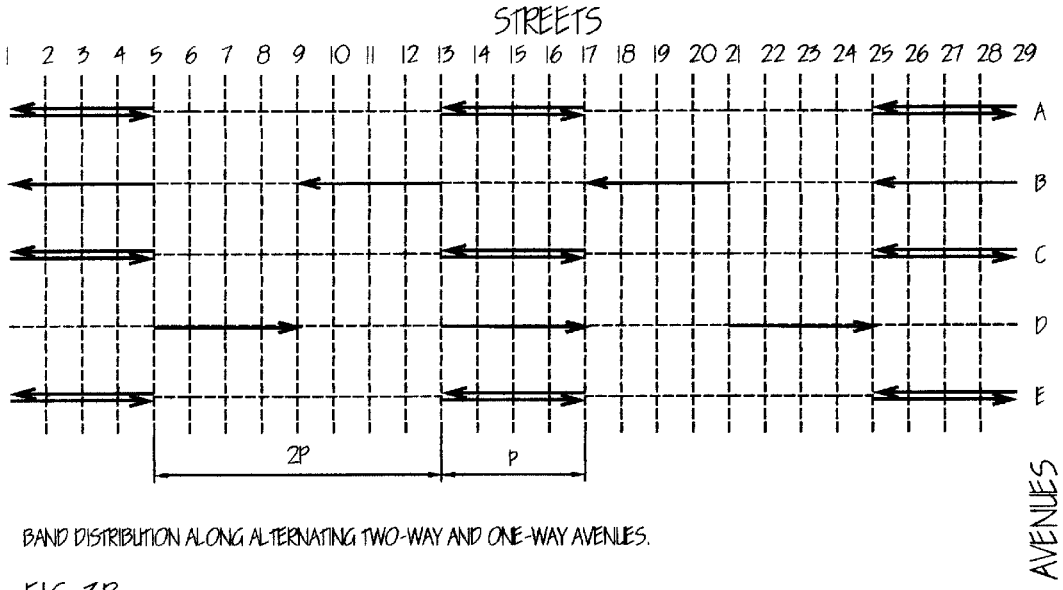
FIG. 3B demonstrates two acceptable combinations for accommodating randomly paired one-way and two-way streets on the same grids.

The time unit "P" is nevertheless the same for both systems, especially when applied to mixed grid configurations, similar to FIG. 3B. It demonstrates two acceptable combinations for accommodating randomly paired one-way and two-way streets on the same grids. In one combination, when in one of three bands within a set along a two-way avenue (such as A,C or E) the green bands are overlapping, the corresponding band along the one-way avenue (such as B or D) is open for cross-traffic. (See Detail E1, FIG. 3B). Additionally, the two remaining bands within the one-way avenue set will be green. In the other combination, shown for example, in Detail E2, FIG. 3B, when one of three bands along a two-way avenue has overlapping green bands, the corresponding band along a neighboring one-way avenue is also green. The two remaining bands within the set is then open for cross-traffic. In an applied context, an acceptance of either combination of one-way or two-way bands will need to be simulation based with a view to optimizing quantifiable goals.

Figure 4:
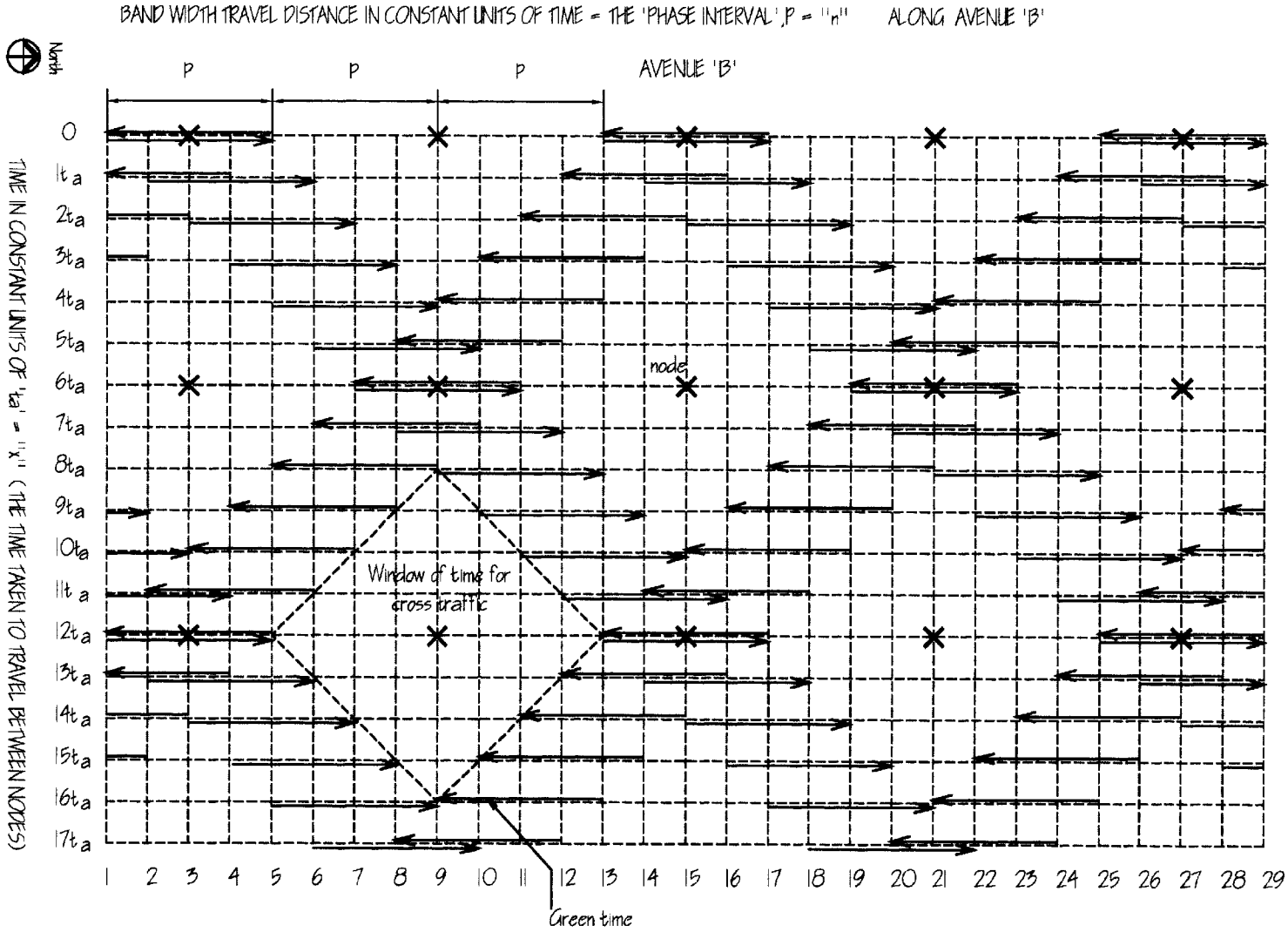
FIG. 4 illustrates the relative progression of two-way traffic along a given length of one of the avenues in a space-time grid.

FIG. 4 illustrates the relative progression of two-way traffic along a given length of Avenue B in a space-time grid. Herein the E/W axis is measured in equal units of time "$t_a$," also defined by the symbol "x" in this disclosure ("$t_a$"="x"). The band length "P" along the N/S axis is shown as "$4t_a$", this assumes that "n=4 (see Equation 4). The progression of vehicular bands in the N/S axis is expanded in a time continuum along the E/W axis. FIG. 4 shows the progression of green bands along Avenue B to be in a crisscrossing pattern in a time dimension. The intervening diamond shaped spaces between the green bands represent available window of time when traffic may cross Avenue B at all nodes within these diamond-shaped spaces. During such time windows traffic signals along Avenue B are red, and those along the cross streets are green. The distribution of red and green intervals in FIG. 4 change in a repetitive pattern in time from node to node. Thus at node 15 (intersection of Ave. B and the $15^{th}$ Street), 4 squares occupied by green bands are repetitively followed by 8 squares with red bands that make up the mid-section of gradually diminishing diamond at other nodes on either side. If the progression diagram represented by FIG. 4 is to be the sole criteria (as may be the case when ATBS 2W is applied to a single arterial), then the signal cycle at node 15 in ATBS-2W is projected to be 4x, i.e., $4t_a$, green for traffic moving along the avenue, which is followed by 8x (or $8t_a$) green for street traffic crossing the avenue and reciprocally 8x red for traffic stopped along the avenue at node 15, and at other similarly configured nodes serially.

The midpoints of diamond shaped time pockets within sets of three bands are uniformly spaced at every "1.5 P", or, "$6t_a$", (also indicated as—"6x", when "x"="$t_a$"). FIG. 4 also demonstrates that every sixth node (i.e., nodes 3, 9, 15, etc.) has alternating changes in the alignment of traffic flow. When nodes 3 & 15 are in a state of maximum overlap in a N/S direction, for example, along Avenue B at starting time "0", nodes 9 & 21 have a maximum window of time for cross traffic in the E/W direction along same avenue.

The distribution of red and green squares in the progression sequence along Avenue B (nodes 1 through 29 inclusive) is also typical to other parallel Avenues A, C, and D. The distribution of red and green time along the streets or avenue for traffic moving along Avenue B, between nodes 3 through 15, is as in Table 1 below:

ATBS-2W Progression Policy Table 1
Red and Green time windows along a two-way avenue for a set of three bands.

| Node | 3 | 4 | 5 | 6 | 7 | 8 | 9 | 10 | 11 | 12 | 13 | 14 | 15 |
|---|---|---|---|---|---|---|---|---|---|---|---|---|---|
| Green | 4x | 6x | 8x | ▽ | 8x | 6x | 4x | 6x | 8x | ▽ | 8x | 6x | 4x |
| Red | 8x | 6x | 4x | ▽ | 4x | 6x | 8x | 6x | 4x | ▽ | 4x | 6x | 8x |

Note 1:
"x" = "$t_a$"
"▽" The red and green time split is repeated 2x red and 4x green.

Figure 4A:
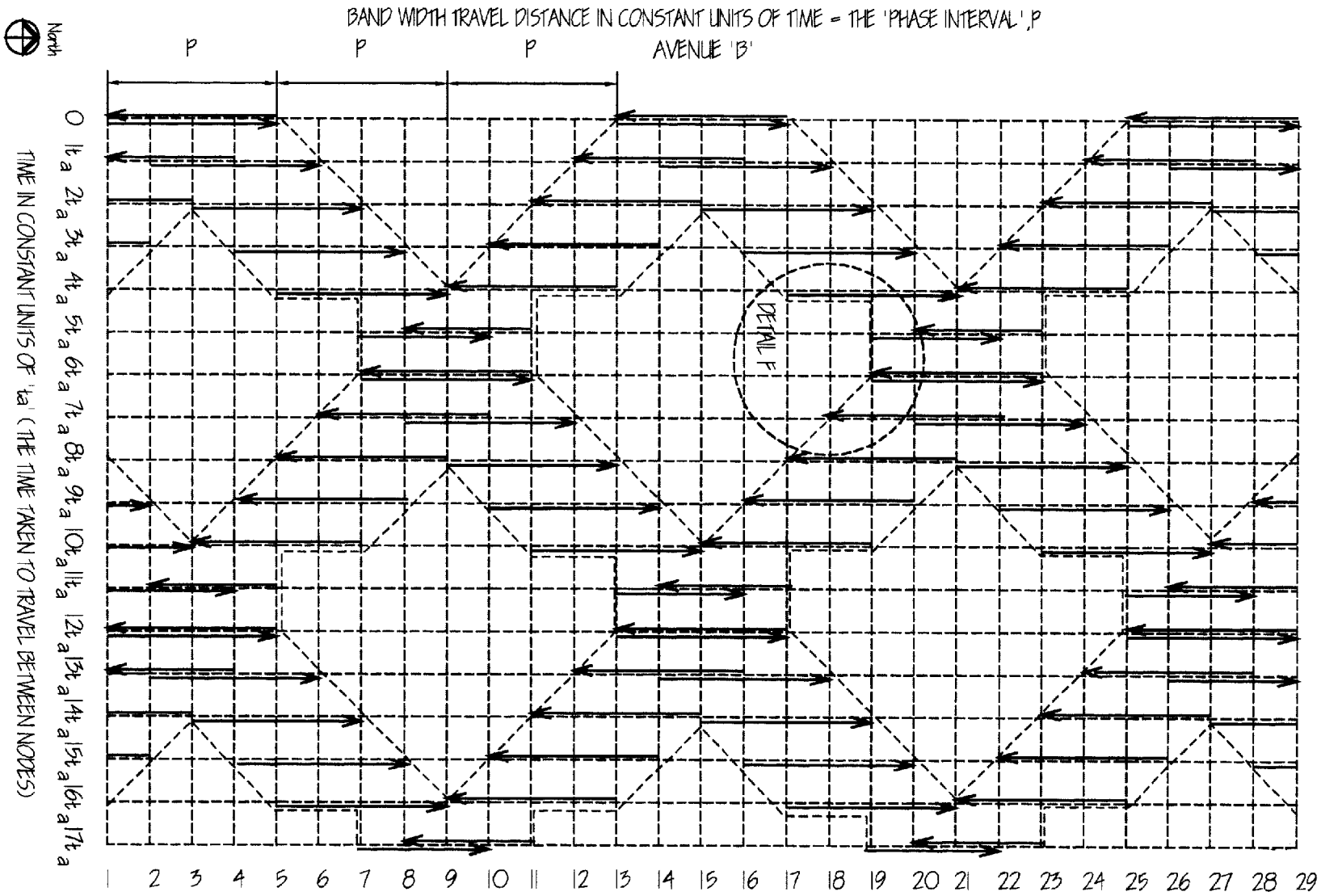
FIG. 4A illustrates the relative progression of FIG. 4 which allows more time for street traffic to cross the avenue by borrowing time from the trailing end of green bands and then restoring it in the succeeding "1x" interval.

The available red and green times at nodes 6 and 12 above may leave insufficient time for pedestrian traffic to cross the avenues (during the 2x interval). This can be changed to allow more time for street traffic to cross the avenue preferably by borrowing time from the trailing end of green bands at such nodes, and then restoring it in the succeeding "1x" interval, as detailed in FIG. 4A, Detail F. The concept may be applied to other intersections that are cohorts to nodes 6 & 12 to achieve a "3x" by "3x" split at all similar cohort nodes when needed.

The movement of two-way bands, also shows a predictable distribution of available time for protected left turns at individual nodes as the green bands move along the two-way avenues in the converging and the diverging modes as below. Arrows, in Tables 2A–2C, indicate the direction of traffic flow along either direction of a two-way avenue, the time available for protected left turns at each node is noted by the "x" entries on the right side of each arrow. The flow direction, be it "north to south" (N/S) or south to north (S/N), is indicated on the side of each table. Double arrows indicate crossing traffic in the East/West direction.

"ATBS-2W" Progression Policy Table 2A
Duration of protected left turns for two green bands in a merging mode.

| Node | 3 | 4 | 5 | 6 | 7 | 8 | 9 | 10 | 11 | 12 | 13 | 14 | 15 |
|---|---|---|---|---|---|---|---|---|---|---|---|---|---|
| N/S | ↓↑ | ↓↑ | 4x | 3x | 2x | 1x | ← | ← | ← | ← | ← | ↓↑ | ↓↑ |
| S/N | ↓↑ | ↓↑ | → | → | → | → | → | 1x | 2x | 3x | 4x | ↓↑ | ↓↑ |

"ATBS-2W" Progression Policy Table 2B
Duration of protected left turns for two green bands in a diverging mode.

| Node | 3 | 4 | 5 | 6 | 7 | 8 | 9 | 10 | 11 | 12 | 13 | 14 | 15 |
|---|---|---|---|---|---|---|---|---|---|---|---|---|---|
| N/S | ↓↑ | ↓↑ | ← | ← | ← | ← | ← | 1x | 2x | 3x | 4x | ↓↑ | ↓↑ |
| S/N | ↓↑ | ↓↑ | 4x | 3x | 2x | 1x | → | → | → | → | → | ↓↑ | ↓↑ |

Nodes 5 through 8 and nodes 10 through 13 have a consistently rising duration of available time for protected left turns in an alternating sequence. There is no available time for protected left turns at node 9. The condition for such turn is slightly better at adjacent nodes 8 & 10. The above progression sequence also produces maximum overlap times on either axis at the $3^{rd}$, $9^{th}$, 15th and $21^{st}$ node, i.e., every $6x^{th}$ node, as shown in Table 2C, below:

"ATBS-2W" Progression Policy Table 2C
Duration of overlap time at all "6x" nodes.

| Node | 3 | 4 | 5 | 6 | 7 | 8 | 9 | 10 | 11 | 12 | 13 | 14 | 15 |
|---|---|---|---|---|---|---|---|---|---|---|---|---|---|
| | ↓↑ | ↓↑ | | | | 2x | 4x | 2x | | | | ↓↑ | ↓↑ |
| | ↓↑ | ↓↑ | | | | 2x | 4x | 2x | | | | ↓↑ | ↓↑ |

Provided "P" is kept constant in a given grid zone, these "1.5P" or "6x" nodes will ordinarily fall along a single alignment along the cross streets. At such nodes, protected left turns will need to be incorporated by use of double left turn signals. One set of signals will allow a two-way avenue traffic to turn off from the N/S axis, i.e., the avenue, to the E/W axis, i.e., the street, as shown in FIG. 5A. The second set of signals will allow a two-way street traffic to turn off from the E/W axis to the N/S axis as illustrated in FIG. 5B. All crosswalks are closed for pedestrians during this maneuver. The exact timing pattern for applying such turns in the context of a larger grid plan is derived out of a detailed analysis of the progression sequence, illustrated in FIG. 3A, in a series of six schematic overlays(shown in FIGS. 6A–6F). Each of the six schematic overlays shows the changing relationship of red and green bands at a constant "2x" time interval. These overlays combine the progression of traffic turning onto the streets, with the progression of two-way bands along the avenues.

As illustrated in FIGS. 6A–6F, each overlay consists of five two-way avenues designated A through E along the N/S axis, and forty-one two-way streets numbered 1 through 41 along the E/W axis. In effect each overlay covers a hypothetical plan area of 205 nodes. All bands (as represented by the solid arrows along the avenues) are four links long from nose to tail. The potential range of movement for traffic turning off onto the side streets from individual nodes within each green band is defined by a wedge-shaped configuration for each green band. They show the potential range of lateral progression on both sides of all green bands, in conformance with the requirements of ATBS-2W outlined earlier, with the minimum travel distance for turning traffic (along the streets) being at the nose, and the maximum being at the tail end of each green band. The pattern repeats itself after six overlays along the alignment of every "6x" or "1.5P" node in an alternating sequence as already noted. The observed pattern of changes at nodes along streets 3, 15, 27 etc. in series (along Avenues A through E inclusive), are summarized on the attached Matrix 1, below:

MATRIX 1
Timing plan for double left turns along on "6x" nodes (3, 15 & 27) in a grid plan.

| Sequence | 0.0 P | 0.5 P | P | 1.5 P | 2 P | 2.5 P |
|---|---|---|---|---|---|---|
| Ave. A | $S_{CN}$ | $S_L$ | $S_{DT}$ | $A_{CN}$ | $A_L$ | $A_{DT}$ |
| Ave. B | $A_L$ | $A_{DT}$ | $S_L$ | S | $S_{CN}$ | $A_C$ |
| Ave. C | $S_{CN}$ | $S_L$ | $S_{DT}$ | $A_{CN}$ | $A_L$ | $A_{DT}$ |
| Ave. D | $A_L$ | $A_{DT}$ | $S_L$ | S | $S_{CN}$ | $A_C$ |
| Ave. E | $S_{CN}$ | $S_L$ | $S_{DT}$ | $A_{CN}$ | $A_L$ | $A_{DT}$ |
| FIGS. | FIG. 6A | FIG. 6B | FIG.' 6C | FIG. 6D | FIG. 6E | FIG. 6F |

Notes:
"C N" = Converge Nose → ←
"D T" = Diverge Tail ← →
"L" = Over-Lapping ↑ ↓
"A" = Avenue traffic
"S" = Street traffic Matrix 1 lists Avenues A–E on the left hand side. It lists phasing sequence from left to right in "0.5P" (2x) time units across the top. Across the bottom it references the relevant drawing from which the information is derived. Each cell shows the relative position and direction of traffic flow i.e., the cells are individually designated in capital letters as either "A or S" to show the direction of traffic flow, be it a street "S" or an avenue "A". Each cell further shows the relative positioning of the leading or trailing edge of vehicular flow, "N" for nose, or, "T" for tail. The Alpha symbols within each cell also show the relative relationship of pairs of green bands along the avenues, be it overlapping (L), diverging (D) or converging (C) at the start of each "0.5P" time unit. By inference the dynamic relationship of the flow sequence changes from cell to cell.

Matrix 1 demonstrates a single "3P" signal cycle, where the red and green signals, in equal and alternating sets of three cells for all Avenues, have an "S" designation for street traffic (corresponding to the red signal along the intersecting avenue) or an "A" designation for avenue traffic (corresponding to the green signal along the avenue). The three-cell "S" and "A" bands alternatingly dovetail into each other by one overlapping cell along the vertical axis. FIG. 6F is repetitively followed by FIG. 6A at the end of a "6x" interval. Matrix 1 demonstrates that opportunities for traffic flow along either axis are equal for all grid intersections along the "6x" axis, as opposed to the apparent conclusion derived out of FIG. 4.

Shaded cells of Matrix 1 show available time windows for inserting double left turns for both streets and avenues at each of "6x" nodes, i.e., nodes 3, 15, 27 etc. along Avenues A through E. Since each of these nodes requires a pair of double left turns, each alignment of the "6x" nodes will require ten (5×2=10) such turns in the context of the streets shown in FIGS. 6A–6F. In eight out of ten instances, these double left turns are preferably placed at the lag-end of each time window, i.e., when the bands are diverging. In the remaining two instances, these double left turns are preferably applied during the leading phase of the signal cycle, i.e., when street traffic is converging on the affected nodes. The exact time interval for implementing such double left turn may be read from time sequence across the top row of Matrix 1.

Vehicular flow at alternating "6x" nodes, i.e. nodes 9, 21 & 33 etc., in series will have the same pattern time windows as that of Matrix 1, except that these alternating "6x" nodes will be programmed with an offset interval of 1.5P."

Crosswalks

Crosswalk signalization is designed to minimize accidents and improve safety, with minimal delays, at both two-way and one-way grid intersections. In the preferred embodiment of the present invention, crosswalks, on the left side only of moving green bands along two-way streets and avenues, are opened to pedestrian traffic as a matter of policy with one exception: crosswalks are open on both sides of a street when traffic flows overlap one-another, and left turns are normally not permitted at nodes, for the duration of the overlap interval. This, consequently, means that all crosswalks are open for a maximum duration of "P" seconds, the time it takes for a band to move past each node (intersection). Crosswalks are recessed from the street corners by a suitable distance, designated as "w,""x,""y" and "z" in FIG. 7A and "n" and "m" in FIG. 7B, to create storage areas for turning traffic, to avoid vehicular queues from backing into and blocking moving lanes along the streets or avenues. The storage distances are individually calculated for each leg to match storage capacity with the required volume of turning traffic, in a "worst case" situation. Recessed crosswalks are safer for pedestrian traffic, as there is more "sight distance and time" for pedestrian and motorists to react to each other in special situations. Whereas recessed crosswalks are needed on all four legs of two-way intersections, crosswalks are recessed at only two legs of one-way intersections, i.e. at outgoing legs only, (see FIG. 7). Even though recessed crosswalks have been earlier adopted in a limited way at some European cities, for example London, its integration in ATBS-2W policy is different from the European model.

The following sequence for crosswalk signalization may be applied in a variety of options at the user's discretion. The preferred sequence makes it possible to achieve a complete separation of all typical modes of street transportation "at grade."

Crosswalk Signalization for Two-way Intersections

Figure 8:
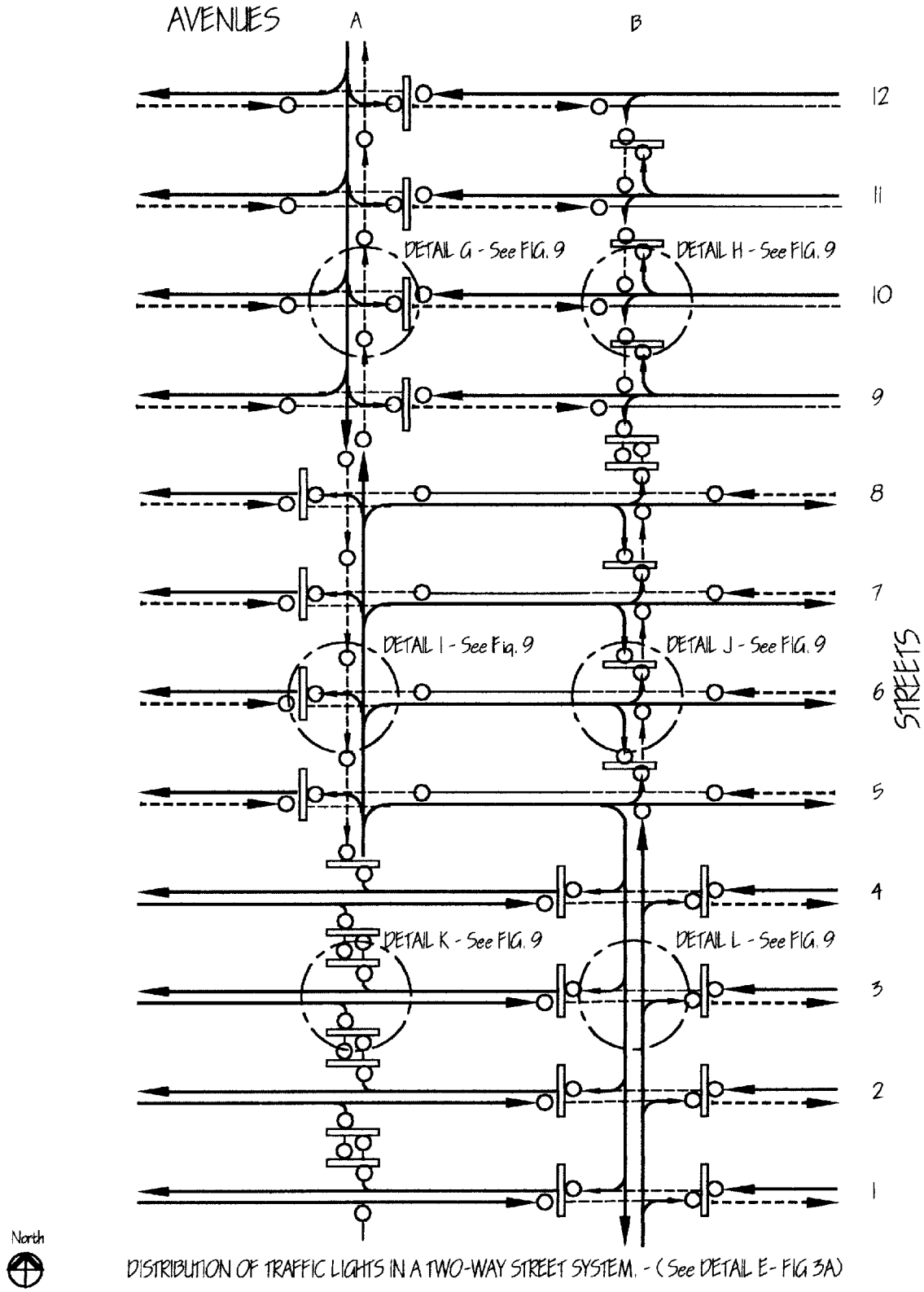
FIG. 8 shows an enlarged layout of moving bands along Avenue B shown in FIG. 3A, Detail E.
Figure 9:
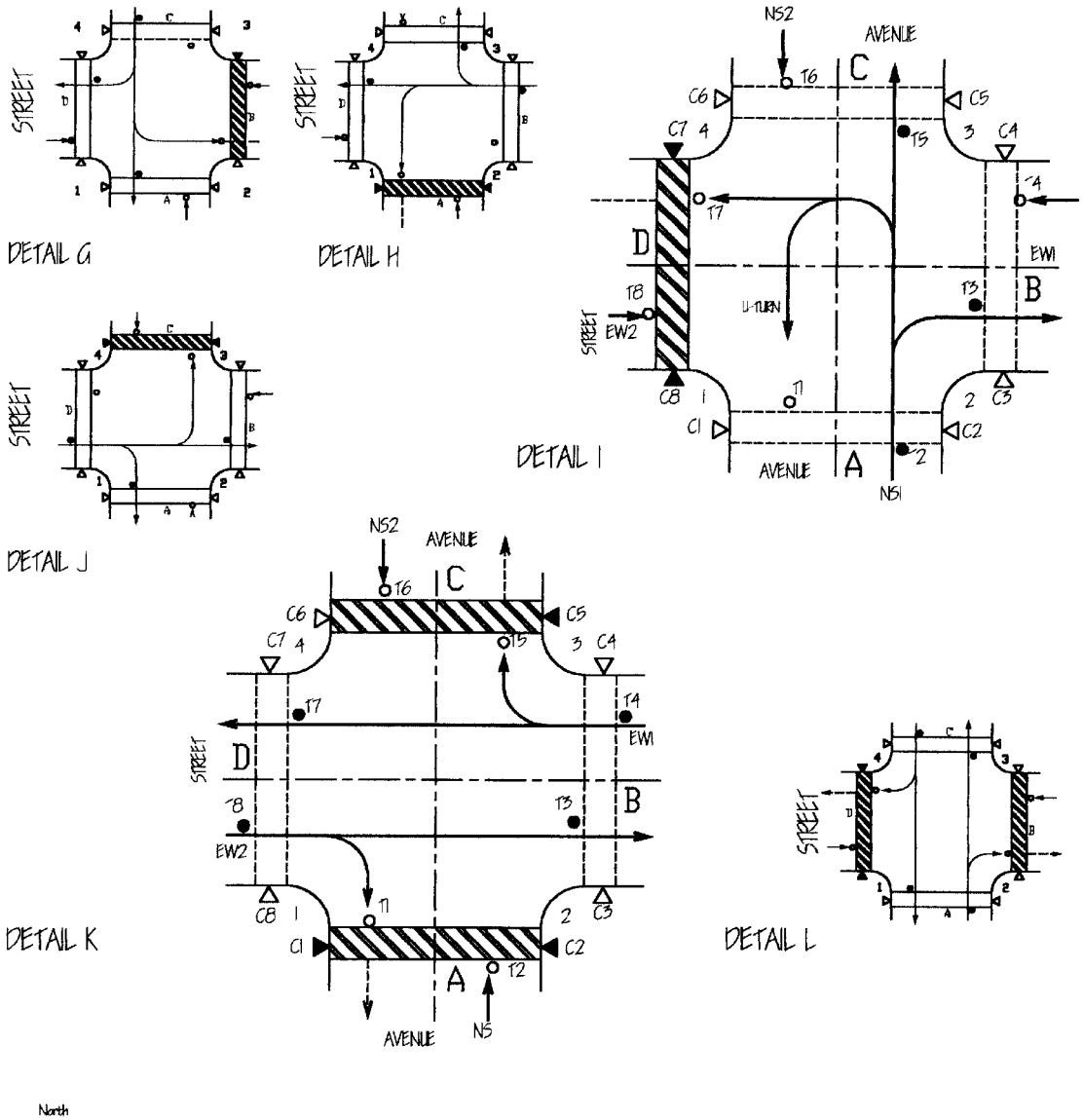
FIG. 9 shows six possible combinations for open crosswalks including four time periods when only one crosswalk is open (Details G, H, I & J), and two time periods when the crosswalks are open on both sides of the street, i.e., when the pairs of green bands are in an overlapping condition along either axis (Details K & L).

FIG. 8 enlarges the layout of moving bands along Avenue B, originally shown in FIG. 3A, Detail E. It demonstrates "The left side crosswalk policy" described above by showing the distribution of open crosswalks on the left side of moving green bands for two adjacent two-way avenues with pairs of 3P clusters. FIG. 8 shows crosswalks opening in tandem pairs along adjacent avenues, i.e., when crosswalk signals are green on Avenue A in a N/S direction, those on Avenue B are green in the E/W direction and vice versa. These show six possible combinations for open crosswalks. There are four time periods when only one crosswalk is open, and two time periods when the crosswalks are open on both sides of the street i.e. when the pairs of green bands are in an overlapping condition along either axis. All six conditions are circled as Details G & H, Details I & J, and Details K & L. All six are enlarged in FIG. 9, which further demonstrates a need for an additional set of signals within the storage areas to regulate the flow of vehicular traffic at the crosswalks in each storage area. In addition to the double left turns (noted earlier), ATBS 2W system preferably applies an additional six phases within the signal cycle at all nodes with overlapping flows, i.e., ATBS 2W will need an six-phase signal cycle at overlapping nodes. Other nodes without an overlapping traffic condition require a four-phase sequence.

Figure 3:
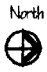

FIG. 8A simplifies the distribution of traffic signals along individual one-way and two-way street lengths to show that there are "linear arrangements of red and green lights" that are preferably continuously progressed as a moving plurality of clusters in ATBS-2W. The cluster size is "2P" for one-way streets and "3P" for two-way avenues as previously noted. The clusters are generically configured about the crosswalk constructs. The relationship of these clusters to adjacent avenues is like that of bringing together a plurality of interlocking cogwheels in a starting arrangement as in FIG. 3; their relative position continuously changes in a space-time continuum. In a customized software application, after an initial coding of the typical cluster sets, the subsequent progression of traffic lights along a plurality of streets and avenues should fall in place like clockwork.

FIG. 8A-B illustrates a contiguous pair of "3P" clusters in a two-way configuration. The red signals in the cluster progressing in a northerly direction are indicated by solid or black dots. Those progressing in a southerly direction are indicated by open or clear dots. The progression sequence requires that traffic signals be coded to change at individual nodes in each of two circumstances in sync with signals at the crosswalks, 1. Protected left and right turns are permitted for traffic moving at a green signal whenever only one crosswalk on the left side is open along either axis of a grid intersection (see Detail I—FIG. 9). Oncoming traffic on the left side of the moving green bands should preferably be stopped before Crosswalk C at a red signal "T6", which in turn is diagonally across and left of the moving green signal "T2" on a two-way avenue, this creates an option to have permitted U-turns at such intersections when street conditions permit. 2. Left turns (including U-turns) should not be permitted when crosswalks are open on both sides of a node on either axis of a grid intersection, (see Detail K—FIG. 9), i.e. when two green bands are overlapping one another.

The typical "3P" cluster of signals consists of three equal "P" size bands, wherein the value of "n" can change from band to band depending on grid geometry. These three clusters consist of, 1. One green band consisting of a moving set of "n" green lights accompanied by one set of "n" red lights to stop traffic approaching the intersection from a side street to its right. These are accompanied by a combination of red and green signals at the crosswalks to the left of the green signals along the avenue. 2. One red band with a set of "n" red lights positioned ahead of the crosswalks on the approach side of the street intersections. 3. One band consisting of "n" red and green lights controlling "crosswalk traffic" on the far (versus the approach) side of the cross-street intersections.

Figure 6A:
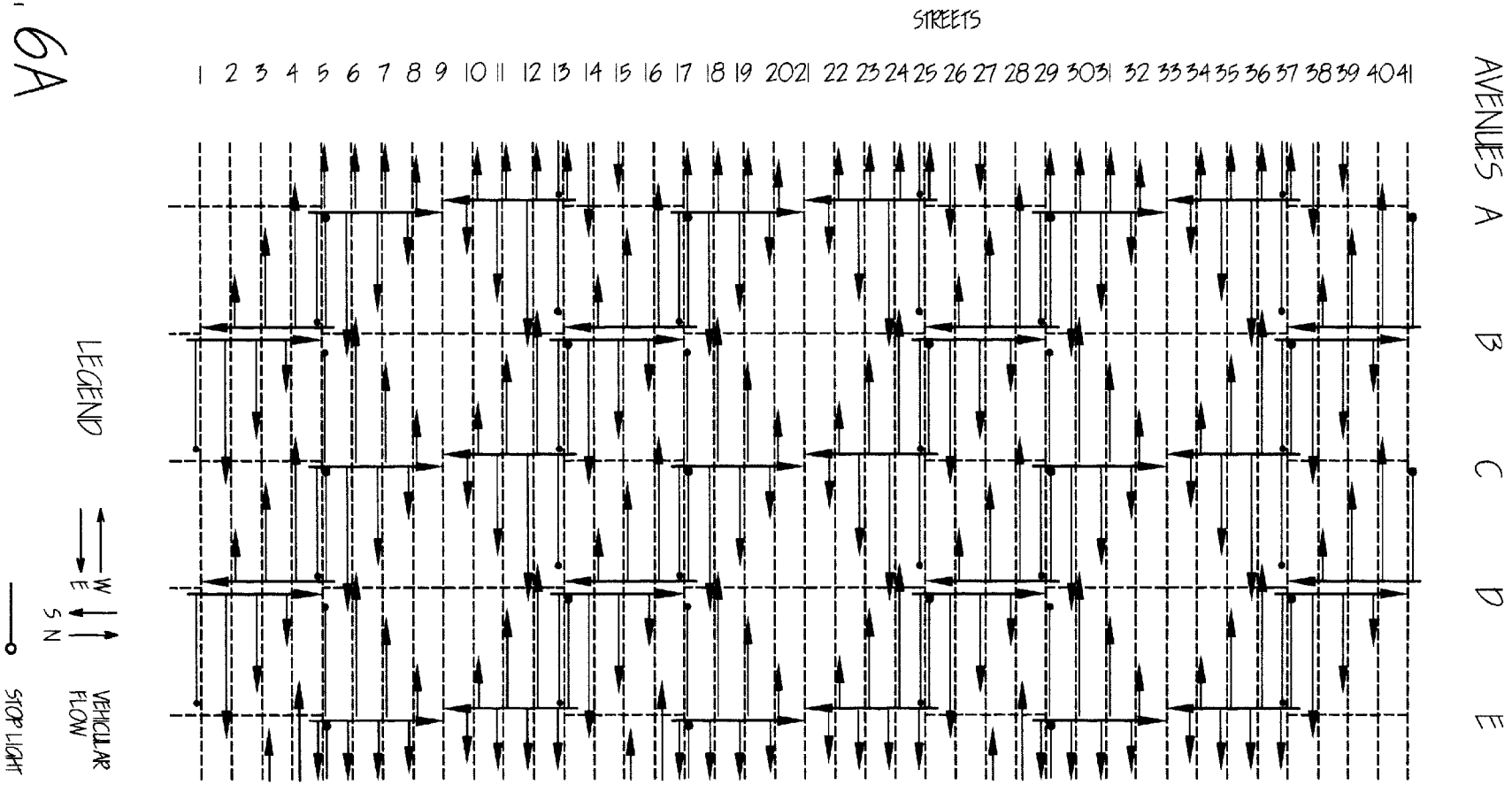
FIGS. 6A–6F illustrate a series of six schematic overlays, each of which shows the changing relationship of red and green bands at a constant "2x" time interval.
Figure 6B:
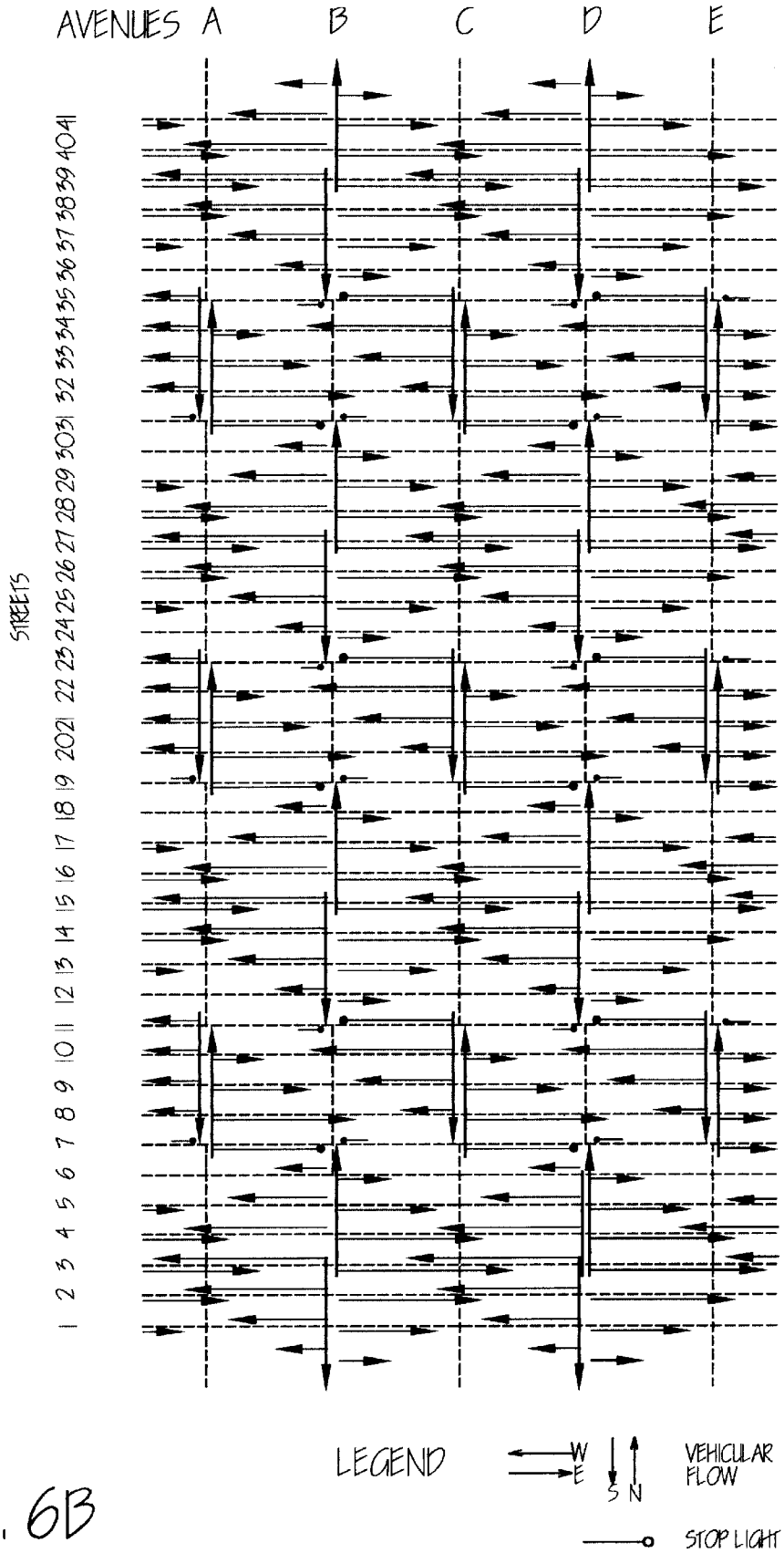
Figure 6C:
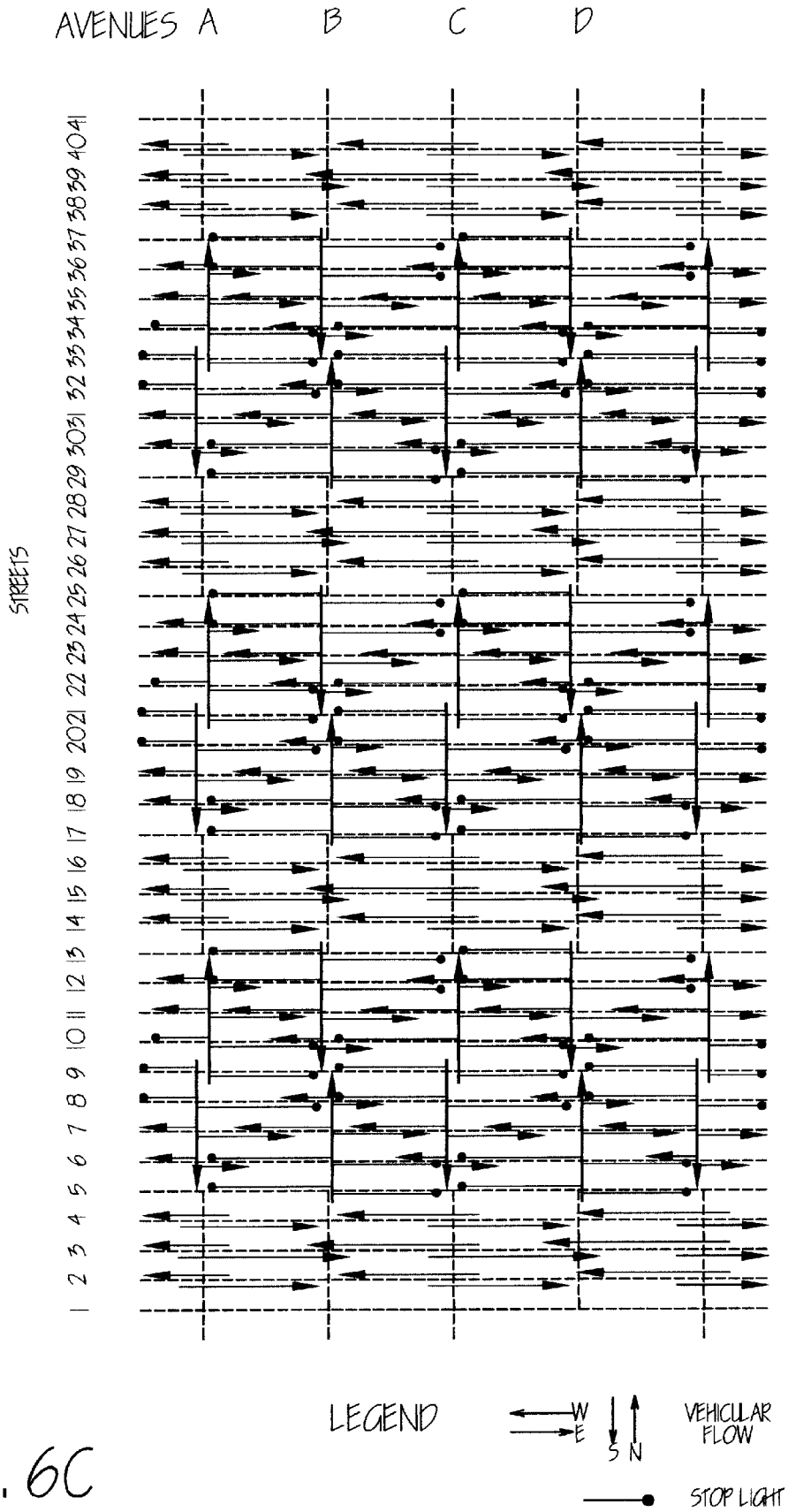
Figure 6D:
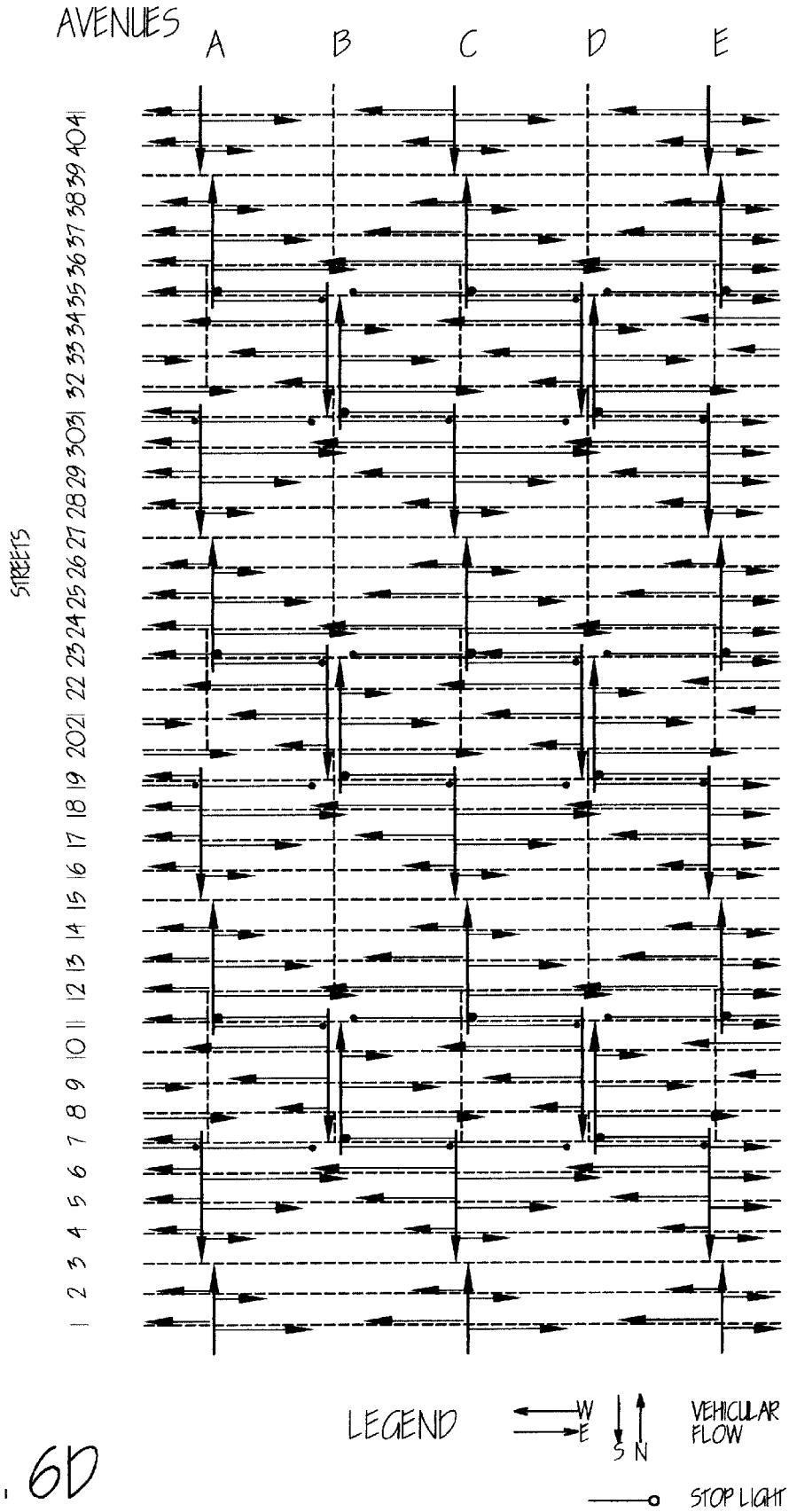
Figure 6E:
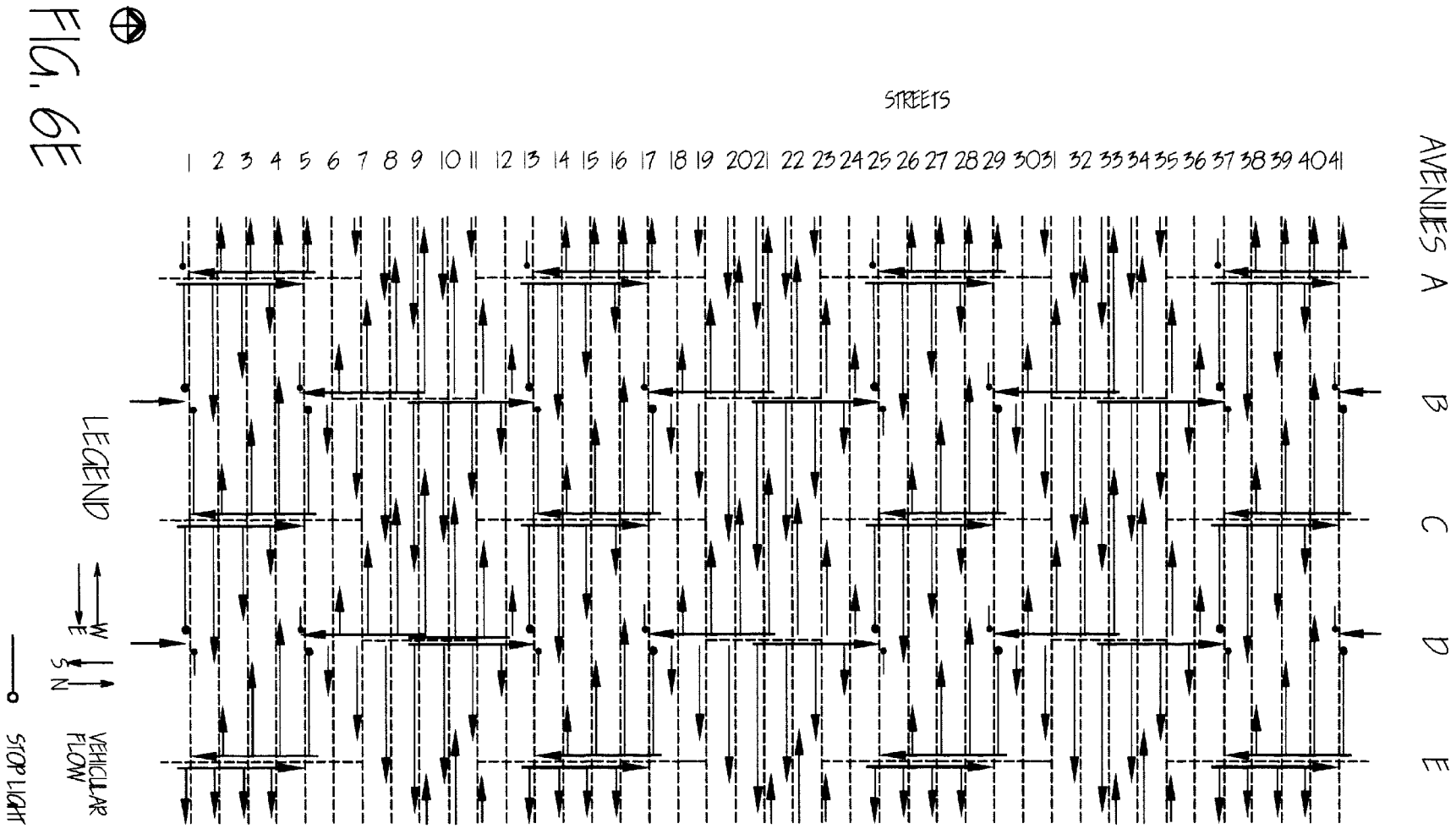
Figure 6F:
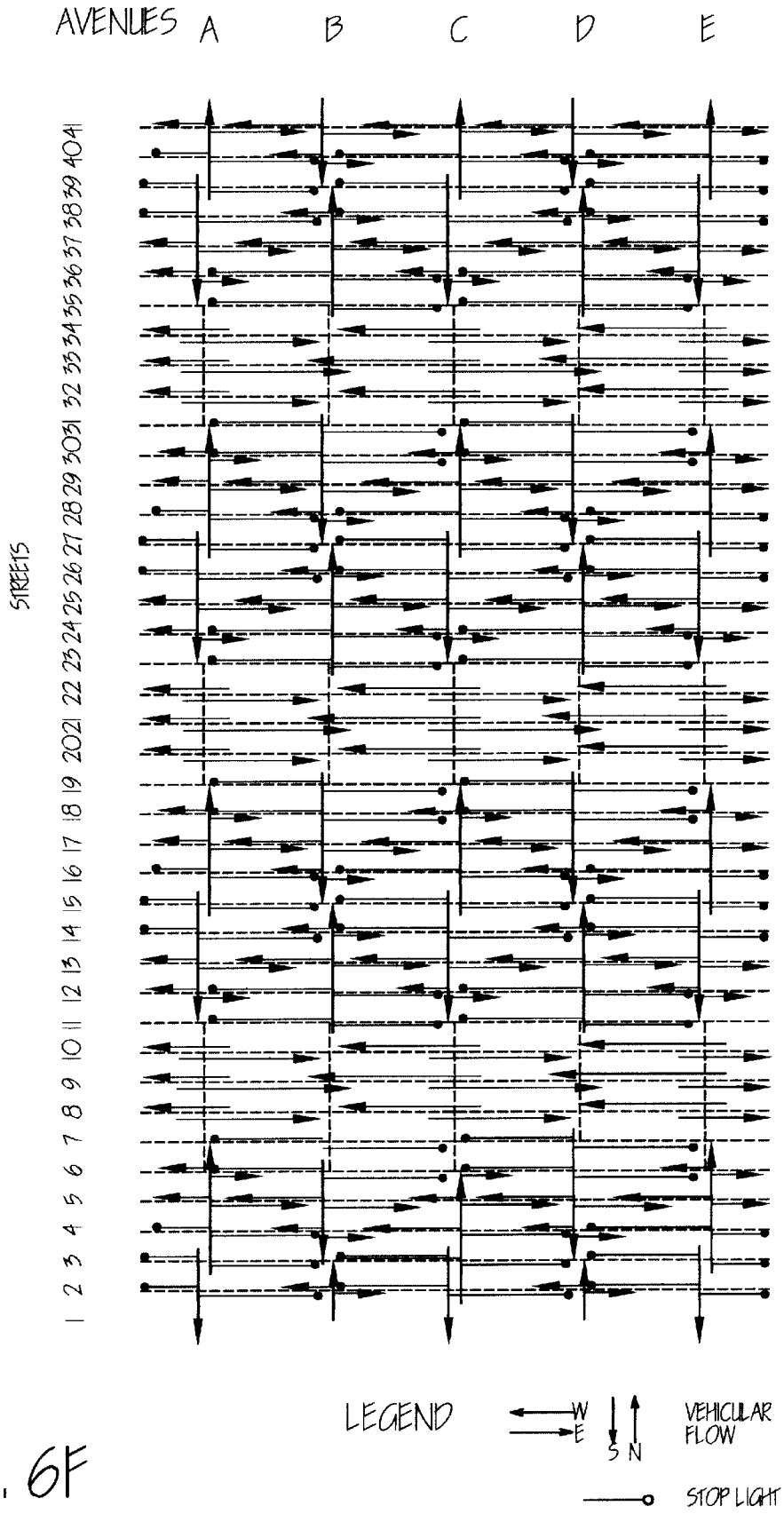
Figure 6A:
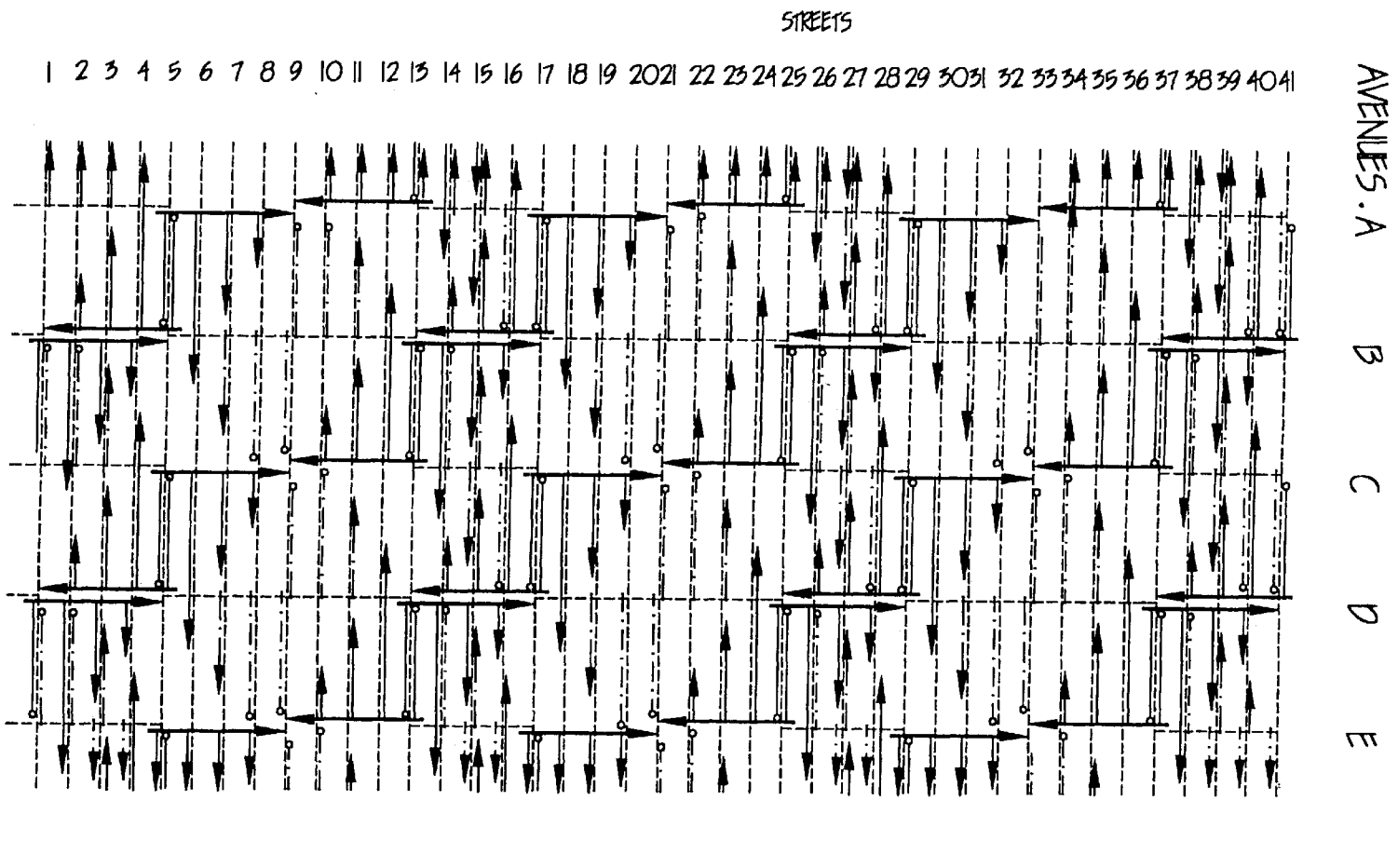
Figure 6C:
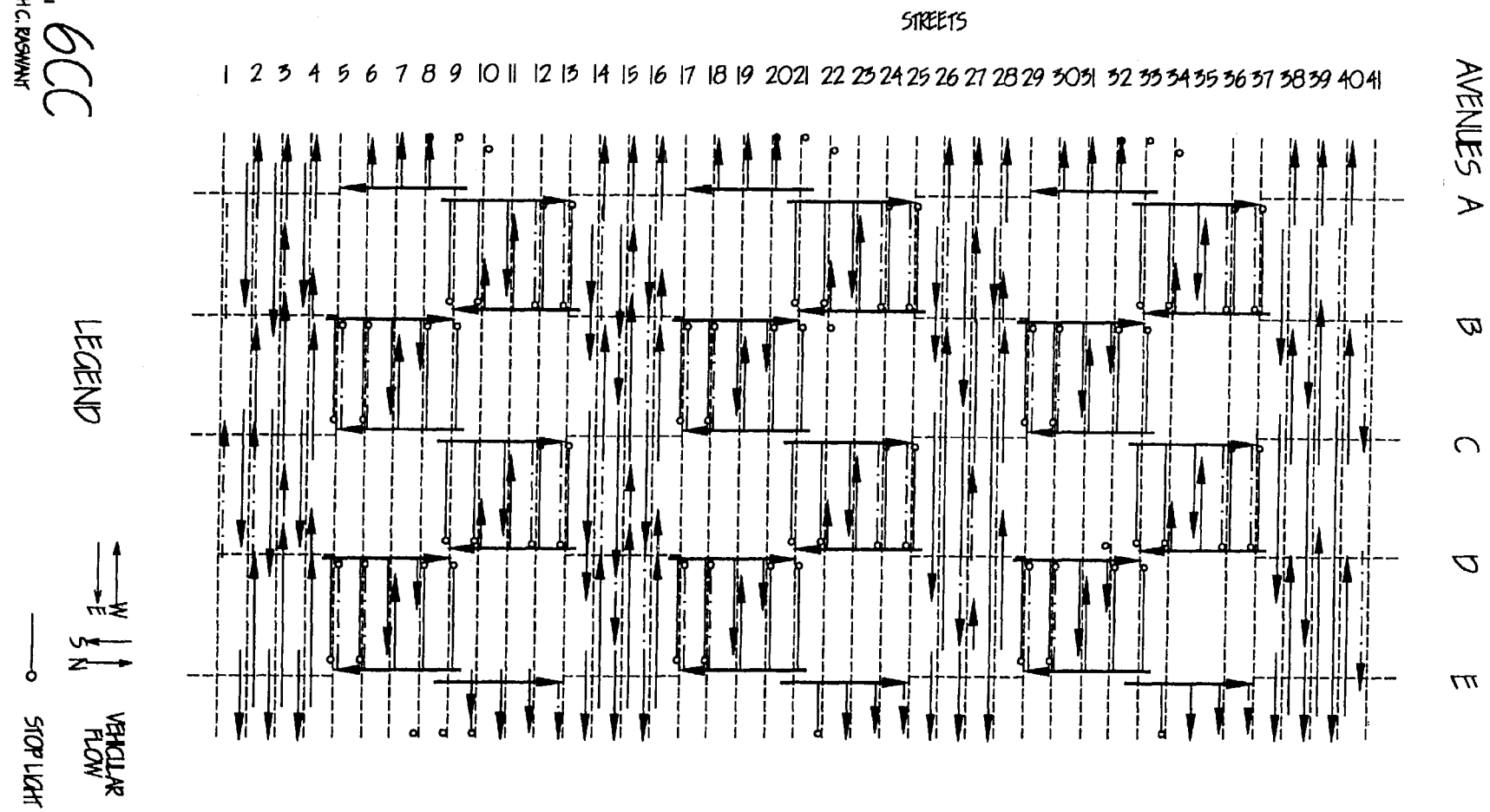
Figure 6E:
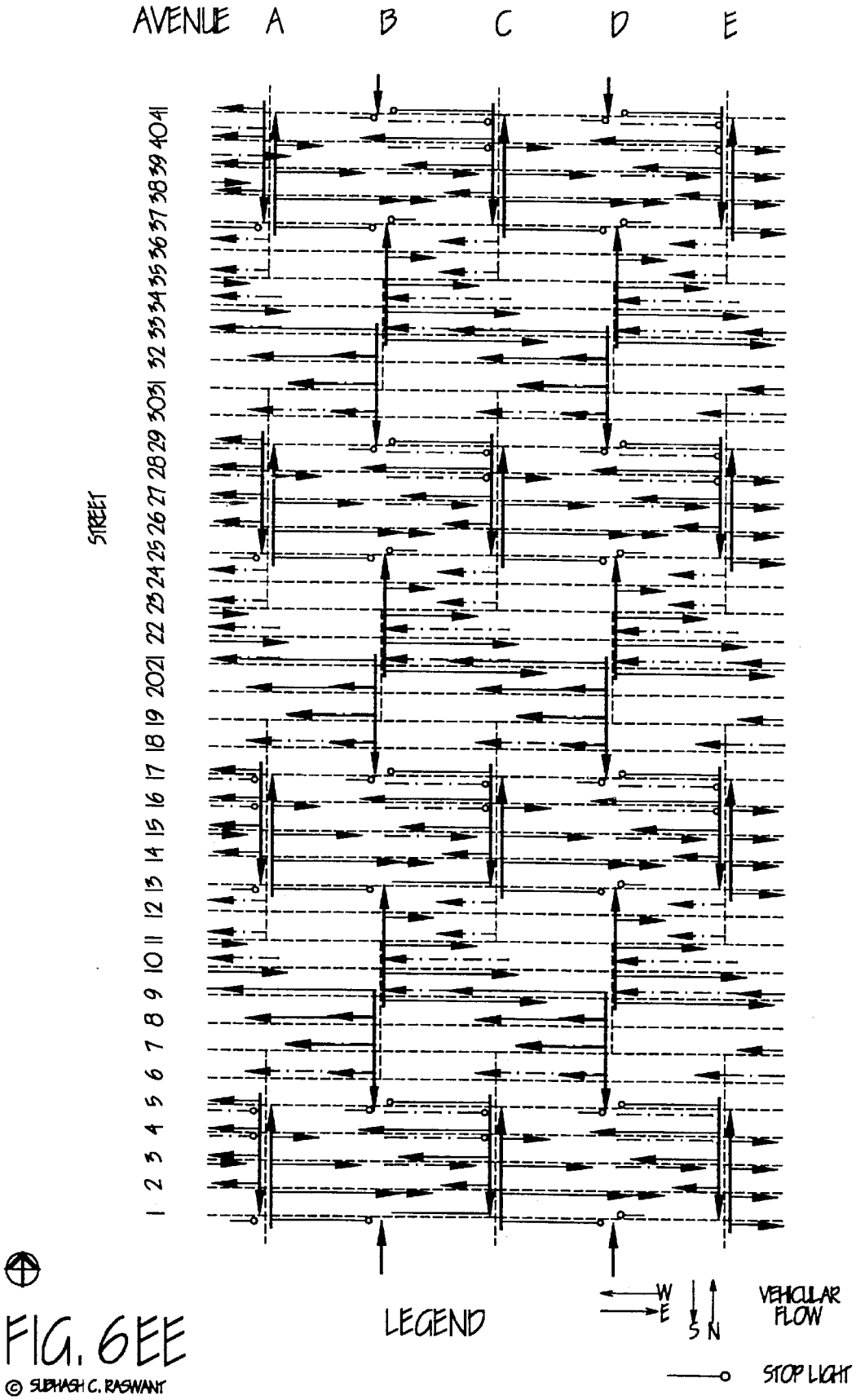
Figure 6F:
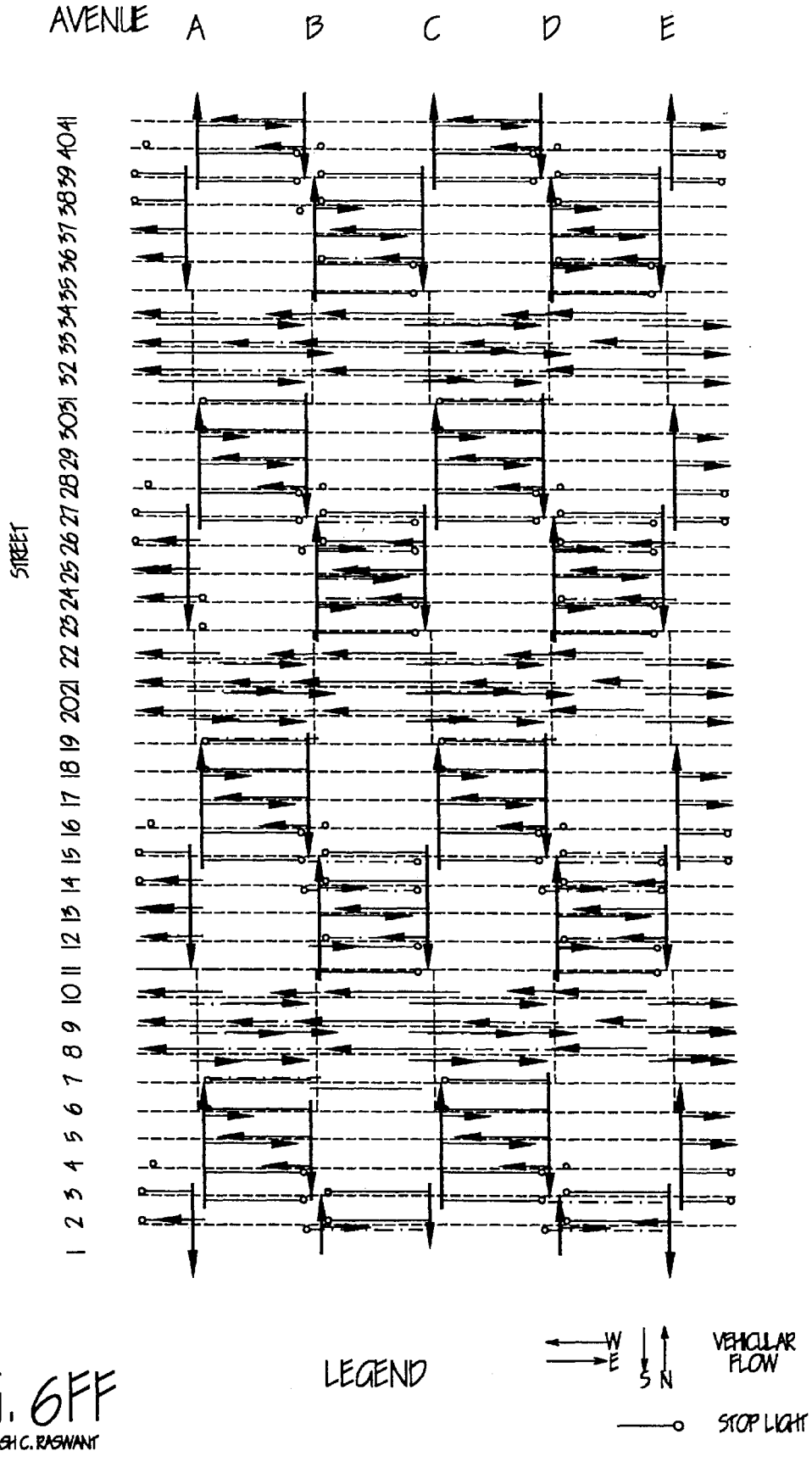

FIGS. 6AA through 6FF (to be distinguished from FIGS. 6A through 6F) show the changed configuration of traffic flow along two-way streets when left turning traffic is stopped before the recessed crosswalks as proposed. The wedge shaped configuration of sets of progressing arrows along the side streets are now changed to a more balanced distribution; primarily due to the fact that the left turning traffic previously stopped on the "left side crosswalks" is displaced by one time interval "P", it now merges with the traffic turning right along the green band approaching it in the opposite direction. This condition of "articulated traffic flow" is better suited to create a condition of protected left turns for street traffic crossing the avenues at all nodes except the "6x" nodes, which will continue to need the double left turns as already stated.

Crosswalk Signalization for One-way Intersections

As illustrated in FIG. 8A-A, crosswalks may be opened in a variety of combinations in the present ATBS-2W system. Whereas only one crosswalk is open at each node within green bands, any combination of two or three crosswalks may be opened to pedestrian traffic at individual nodes within red bands. In certain situations, one crosswalk along an outgoing leg of a cross-street may even be suppressed at nodes within red bands, as shown in dotted lines in FIG. 8A-A.

"Details M & N" of FIG. 10 show the underlying logic in a progression cycle, when vehicular traffic originating at node A/14 turns in an easterly direction, in the context of "Detail B" of FIG. 1.

In first Phase "P1" (when traffic signals in the N/S axis are green on Avenue A and red on Avenue B), a vehicular platoon "K1", turning east on Street 14 should normally proceed to a point "a" somewhere between Avenues B and C. The time distance between Platoon "K1" at point "a" and Node C/14 is "$t_b$–$t_a$" in first Phase "P1" (See Detail M). During a second Phase "P2", when traffic signals along Avenue B turn green, and those along Avenues A & C turn red, same Platoon "K1" should proceed from point "a" to a point approaching node D/14, provided travel times between node A/14 through D/14 are constant (See Detail N). During Phase 2 , a second platoon "K2" will have originated at node B/14 and progressed to a point "b" somewhere between Avenues C and D during phase "P2". The time interval between Platoons K1 and K2 is "$t_a$" sec's". Thus, at any given time, there are at least two platoons K1 & K2 along any street length at the start of a typical red phase.

It is also noted that the uninterrupted movement of traffic turning off on to the side street from a node with a green signal along the avenue is critical to its ability to achieve its maximum travel distance along the side streets in a one-way system; this is best achieved by minimizing delays at the crosswalks at the outgoing leg of the cross streets as an option. Starting with this as a basic premise, under the ATBS-2W signalization policy "without bicycles" (as in FIG. 11) it is preferred that during the green phase, only crosswalk "D" is open to pedestrian traffic on one-way intersections, vehicular traffic is as configured in FIG. 11—Detail O. During the red phase (see FIG. 11—Detail P) crosswalk B may be suppressed, or it may be opened for a period "$t_b$–$t_a$" (see next section under bicycles), and the remaining two crosswalks "A & C" open to pedestrian traffic together. They close at separate intervals starting with crosswalk "A" being open for the full duration of phase interval "P". Crosswalks "C" may either be kept open for the full duration of the Phase interval "P", or, if needed, be kept open for a lesser time period "P–$t_a$". This shorter period of available time for crosswalks "C" permits traffic to enter into the pocket past the crosswalk in the remainder of the phase duration "P", i.e. "$t_a$", to minimize traffic build up in the pertinent storage area.

As noted earlier, the time distance between the leading edge of Platoon "K1" and the red signal at the intersection ahead of it (see FIG. 10—Detail N), creates a window of time that can be exploited to open crosswalk "B". The available time window may be increased by a factor "$f_z$", the time distance from center point of the intersection and crosswalk "B" in the relevant storage area in certain situations. Provided this time gap is respected, any delays for odd vehicles that stop at crosswalk "B" are projected to be minimal. In case the delay at crosswalk B exceeds the suggested limit, Platoons K1 and K2 will merge towards one another for the duration of any additional need based delay at crosswalk "B".

Bicycles

The ATBS-2W model can inherently accommodate dedicated bikeways for both one-way and two-way street grids; it requires some design changes in the layout of traffic signals and some additional bicycle lanes to be built into the roadways on grid plans. The end objective is to maximize the safety of bicyclists at grid intersections.

Bicycle flow on one-way street systems is derived out of the ATBS-2W crosswalk signalization policy for one-way intersections, discussed earlier, and is based on an accepted policy to keep bikeways on the right side of all one-way streets. The concept of a dedicated bicycle lane between the sidewalk and the parking lane is the same as that for the two-way system. Signalization takes place in three phases. During the green signal when traffic is moving in a N/S direction; bicycle traffic should not cross a one-way intersection during the dominant green phase for vehicular traffic, as stated earlier in the crosswalk policy. The signalization diagram is the same as FIG. 11—Detail O, i.e. only Crosswalk D is open to pedestrian traffic. Bicycle traffic is stopped at crosswalks A & D. Vehicular traffic approaching the intersection along Avenue NS1 proceeds through the intersection, or turns right on street EW1 uninterrupted since "Crosswalk B" is suppressed. Bicycle traffic may also turn onto street EW1 without crossing it, if conditions warrant.

During the "Red Signal" (when cross traffic is moving through the intersection in an E/W orientation) vehicular and bicycle traffic is managed in a two-stage sequence in either of the following two options. Crosswalks "A & D" are closed to pedestrian traffic, and in one option Crosswalks "B & C" are open to pedestrian traffic during an initial time interval "$t_b$–$t_a$" (the time it takes for leading platoon K1 to reach the intersection—see FIG. 10). Vehicular traffic is stopped at red lights at the two approach-legs NS1 and EW2 at crosswalks A & D. Bicycle traffic which is allowed only from the two approach legs (NS1 & EW2) through crosswalks "A & D", merge at intersection corner "2" and filter through crosswalk "B". Bicycle traffic, seeking to proceed to departing leg NS2, may make ajug-handle maneuver past along crosswalk "B" to intersection corner "3" (as in "FIG. 11—Detail R") move into departing leg (NS2), to either stop before, or to filter through crosswalks "C".

In a second option (not illustrated) it is also practicable to allow vehicular traffic from approach leg EW2, to proceed through the intersection and stop before crosswalks "B & C" in the storage area without adversely impacting the movement of either bicycle or pedestrian flow (as illustrated in "Detail R"), best in situations with small amounts of bicycle traffic.

In this regard it is important to note that the time duration "$t_b$–$t_a$" in of itself is sufficient to permit pedestrian traffic to cross smaller streets at "Crosswalk B", even when bicycle and pedestrian traffic are required to filter past one another. In other situations, when "Crosswalk B." is kept open for a longer time period, the notional value of "P" may have to be adjusted on a spot basis to accommodate the time required for bicycle traffic. The additional time factor "$f_z$" (see FIG. 10) built into the storage area before "Crosswalk B", as previously noted, provides a convenient window of additional time that can be applied in a number of ways. In other situations Crosswalk B may be suppressed when needed.

During the remaining red phase "$P-(t_b-t_a)$", (FIG. 11—Detail P), Crosswalks "B & D" are closed to pedestrian traffic. Crosswalk "A" is opened to pedestrian traffic while Crosswalk "C" continues to remain open to pedestrian traffic, as earlier. Vehicular traffic originating from leg "EW2" either moves through the intersection past Crosswalk B, or it turns into the storage area ahead of Crosswalk C (if it did not already do so in the earlier interval). Bicycle traffic may also proceed through the intersection in parallel with the vehicular stream from approach leg "EW2" past "Crosswalk A" to outgoing leg EW1, without turning into the vehicular flow direction.

Bicycle flow on two-way street systems is designed to function in sync with the directional flow of two-way traffic, preferably on dedicated one-way bikeways on both sides of each two-way avenue or street. Bicycle traffic moves on the "left side" of the moving green bands in the opposite direction along an avenue or street, it crosses the intersections by making a "jug handle maneuver" alongside the open crosswalk, as illustrated in FIG. 12—Details S & T. The signalization of these dedicated bikeways is in the same sequence as that of the crosswalks. FIG. 12—Detail U shows a preferred location for dedicated bikeways on both sides of two-way streets or avenues, i.e. between the sidewalk and the parallel parking lane, for the safety of bicyclists.

The integration of a bicycle flow in ATBS-2W has some universal implications that merit mention in the current context. Whereas bicycle traffic is an insignificant component for all traffic on North American and European cities, one major reason for its decline as an acceptable mode of transportation in cities is the high level of personal risk for bicyclists at street intersections in the current model. A system of dedicated bicycle routes on city streets can greatly expand its appeal as a popular means of transportation in center cities with positive implications in terms of grid congestion, and environmental air quality.

Bicycle traffic, together with other forms of non-motorized transportation, is a significant component of street traffic in most Asian and African cities. The prevailing momentum in urban and economic development is propelling these countries towards a greater dependence on automotive traffic in the current model. The timely development of a suitable bicycle policy can avert the type of traffic jams that are already evident in many cities in the region. Many of these countries do not have the resources to sustain a long-term program of urban development, based on the energy intensive transportation policy in the western model.

The provided ATBS-2W method has considerable latitude for need based spot adjustments. First, the required duration of the red or green window of time may be adjusted in the framework of a progression sequence along an avenue by borrowing time from traffic moving in a lateral direction at specific nodes. Then, the optimized value of "P" may be adjusted for different time intervals in a day, or week. The value of "n" may, similarly, be altered to accommodate uneven offset distances between nodes along any route, provided the overall value of "P" is constant. As noted earlier, crosswalk signal phasing may be modified within certain parameters, to change available time for pedestrians and or specific conditions relating to vehicular movement at some intersections. Finally, the recessed distance for crosswalks may be adjusted to match the volume of turning traffic with that of street capacity within the recessed areas. It is even possible to suppress "Crosswalks B" in certain conditions, to the benefit of vehicular flow along one-way streets.

Having described this invention with regard to specific embodiments, it is to be understood that the description is not meant as a limitation since further variations or modifications may be apparent or may suggest themselves to those skilled in the art. It is intended that the present application cover such variations and modifications as fall within the scope of the appended claims.

What is claimed is:

1. A road traffic control system comprising:

a road traffic network, said road traffic network having a first set of road portions for advancing vehicular traffic flow, a second set of road portions for advancing said vehicular traffic flow and a plurality of grid-like intersections between said first set of road portions and said second set of road portions;

a traffic control signal located at each of said intersections, each of said traffic control signals having a "green" phase/indicating the flow of said vehicular traffic flow across said intersection, and a "red" phase indicating the prohibition of vehicular traffic across said intersection;

wherein at least one road portion within said first set of road portions is a two-way road portion, wherein at least one road portion within said second set of road portions is also a two-way road portion, wherein said traffic control signals are independently programed to allow said vehicular traffic flow to advance in each direction of said two-way portions, wherein sets of two or more of said traffic control signals further segment said first set of road portions into a plurality of bands, said bands comprising a discrete number of neighboring intersections equal to or greater than two, each of said bands being a "green" band when said traffic control signals along said band is in said "green" phase or a "red" band when said traffic control signals along said band is in said "red" phase, wherein said "green" and "red" bands are alternating in checkerboard arrangement in relation to adjacent first set of road portions and wherein said traffic control signals are programmed according to a multiple of the formula $P=t_b+t_a+2f_t$ wherein P is a time duration, $t_b$ is the desired travel time between said road portion of said first set of road portions, $t_a$ is the desired travel time between said road portion of said second set of road portions, and $f_t$ is the time required to make one turn from a road portion of said first set of road portions to a road portion of said second set of road portions.

2. A road traffic control system according to claim 1 wherein said traffic control signals have a "left turn" phase, wherein during said left turn phase said vehicular traffic flow along said first set of road portions and said second set of road portions can make a protected left turn and a simultaneous right turn.

3. A road traffic control system according to claim 1 further comprising a plurality of crosswalks at each of said intersections, said crosswalks allowing pedestrians to cross said first set of road portions and said second set of road portions.

4. A road traffic control system according to claim 3, wherein at least one of said plurality of crosswalks at each of said intersections is distanced from said each intersection so as to create a storage area for said vehicular traffic flow turning into said storage area.

5. A road traffic control system according to claim 1, wherein said "green" and "red" phases of said traffic control lights have a predeterminable signal cycle C, said signal cycle is being nearly equal for said "red" and said "green" phases.

6. A road traffic control system according to claim 5, at least one road portion within said first set of roads is a one-way road portion and wherein said signal cycle C equals 2 times P for said one-way road portion.

7. A road traffic control system according to claim 5, wherein said signal cycle C equals 3 times P for said two-way road portions.

8. A road traffic control system according to claim 5, wherein said signal cycle C is adjustable based on empirical studies of traffic flow.

9. A road traffic control system according to claim 5, wherein at least one road portion within said second set of roads is a one-way road portion and wherein said signal cycle C equals 2 times P for said one-way road portion.

10. A road traffic control system according to claim 1, wherein said bands are organized into a plurality of band clusters.

11. A road traffic control system according to claim 10 wherein each of said band clusters comprises three of said bands.

12. A road traffic control system according to claim 11, wherein two of said three bands within at least one of said band clusters are "green" bands.

13. A road traffic control system according to claim 11, wherein two of said three bands within at least one of said band clusters are "red" bands and a third band of said three bands is a green band for traffic moving in one direction along said two-way road portions.

14. A road traffic control system according to claim 11, wherein one of said three bands within at least one of said band clusters is a "green" band allowing said vehicular traffic to turn from said first set of road portions onto said second set of road portions.

15. A road traffic control system according to claim 11, wherein one of said three bands within at least one of said band clusters is a "green" band allowing said vehicular traffic to cross said first set of road portions.

16. A road traffic control system according to claim 10, further comprising a plurality of crosswalks for pedestrian traffic, wherein at least a pair of said crosswalks is open in a predeterminable sequence at a number of intersections within each of said clusters.

17. A road traffic control system according to claim 1, further comprising a plurality of crosswalks for pedestrian traffic, wherein at least one of said crosswalks is open at each of said intersections during said "green" band along said first set of road portions.

18. A road traffic control system according to claim 17, wherein said open crosswalk is located to an immediate left of a green traffic light.

19. A road traffic control system according to claim 1, further comprising a plurality of sidewalks, a plurality of parking lanes, said sidewalks and said parking lanes located along said first set of road portions, and a plurality of bicycle lanes, said bicycle lanes located between said parking lanes and said sidewalks.

20. A road traffic control system according to claim 19, further comprising a set of bicycle traffic lights, said bicycle traffic lights being synchronized with said green bands.

21. A method for controlling vehicular and pedestrian traffic flow and traffic light controls on a road traffic network, said network having a plurality of grid-like intersections between a first set of road portions and a second set of road portions, wherein at least one road portion within said first set of road portions is a two-way road portion, wherein at least one road portion within said second set of road portions is a two-way road portion, wherein traffic can cross said intersections, and wherein said first set of road portions is further segmented into a plurality of bands of equal length, said method comprising the steps of: providing a plurality of traffic control signals located at each of said intersections, each of said traffic control signals having a "green" phase allowing said vehicular traffic flow to cross said intersections and a "red" phase prohibiting said vehicular traffic flow from crossing said intersections;

programing said traffic control signals to allow said vehicular traffic flow to advance independently in either direction of said two-way road portions; and calculating a time interval for said "green" and "red" phases of said traffic control lights, said time interval being calculated based on a multiple of the formula $P=t_b+t_a+2f_t$ wherein P is a time duration, $t_b$ is the desired travel time between said road portion of said first set of road portions, $t_a$ is the desired travel time between said road portion of said second set of road portions, and $f_t$ is the time required to make one turn from a road portion of said first set of road portions to a road portion of said second set of road portions.

22. A method according to claim 21 further comprising a step of providing a plurality of crosswalks at each of said intersections, said crosswalks allowing pedestrians to cross said first set of road portions and said second set of road portions.

23. A method according to claim 22 further comprising a step of distancing at least one of said plurality of crosswalks away from said intersection so as to create a storage area for said vehicular traffic flow.

* * * * *